United States Patent [19]

Schefer et al.

[11] Patent Number: 4,497,450

[45] Date of Patent: Feb. 5, 1985

[54] FILAMENT WINDING MACHINE

[75] Inventors: Kurt Schefer, Winterthur; Kurt Salvisberg, Gächlingen, both of Switzerland

[73] Assignee: Sulzer Brothers Limited, Winterthur, Switzerland

[21] Appl. No.: 411,701

[22] Filed: Aug. 26, 1982

[30] Foreign Application Priority Data

Nov. 10, 1981 [GB] United Kingdom ..... 8133836

[51] Int. Cl.[3] ..... B65H 54/02; B65H 67/04

[52] U.S. Cl. ..... 242/18 A; 242/18 DD; 242/18 PW

[58] Field of Search ..... 242/18 A, 18 DD, 18 PW, 242/25 A

[56] References Cited

U.S. PATENT DOCUMENTS

| | | | |
|---|---|---|---|
| 2,789,774 | 4/1957 | Petersen et al. | 242/18 A |
| 2,957,635 | 10/1960 | Bisbe | 242/18 A |
| 3,149,795 | 9/1964 | Rhein, Jr. | 242/18 A |
| 3,334,827 | 8/1967 | Jackson | 242/18 A |
| 3,532,278 | 10/1970 | Sparling | 242/18 A |
| 3,758,042 | 9/1973 | Sear | 242/18 A |
| 3,761,029 | 9/1973 | Seney | 242/18 A |
| 3,856,222 | 12/1974 | Wust | 242/18 A |
| 4,141,513 | 2/1979 | Miller | 242/18 A |
| 4,141,514 | 2/1979 | Miller | 242/18 A |
| 4,298,171 | 11/1981 | Fluckiger et al. | 242/18 A |

FOREIGN PATENT DOCUMENTS

| | | | |
|---|---|---|---|
| 33859 | 10/1970 | Japan | 242/18 A |
| 761689 | 11/1956 | United Kingdom | 242/18 A |

*Primary Examiner*—Stanley N. Gilreath

*Attorney, Agent, or Firm*—Kenyon & Kenyon

[57] ABSTRACT

A filament winder of the automatic exchange type in which chucks are brought successively into winding positions relative to a friction drive roller and thread is transferred from a package on an outgoing chuck to a bobbin on an incoming chuck. Each chuck moves along its own predetermined path towards and away from the friction drive roller. A free thread length is created between the friction drive roller and the outgoing chuck and this free thread length is intercepted by thread catching means on the incoming chuck.

12 Claims, 18 Drawing Figures

FILAMENT WINDING MACHINE

The present invention relates to developments in the art of winding of threads, particularly but not exclusively filaments of synthetic plastics material.

PRIOR ART

In winding of synthetic threads, particularly hightiter threads such as texturized carpet yarn and tire cord, it is now well known to use a so called "revolver", in which rotatable chucks are mounted on a carrier head which is itself rotatable about an axis fixed in a winder frame. While continuously supplied thread is being wound into a package on one of the chucks, the other chuck is held in reserve. When winding of the package is complete, the "reserve" chuck is brought into a winding position by rotation of the carrier head, newly supplied thread being severed from the completed package and connected to the chuck newly arrived in the winding position so as to be wound into a package on this latter chuck. Thus, thread can be wound substantially continuously and without any substantial waste during the transfer operation from one chuck to another. Such revolver-type machines are described, e.g. in U.S. Pat. Nos. 3,856,222; 3,941,321; 4,283,019, in European published application No. 78300409 (U.S. Continuation No. 129,625) and British Patent Specification No. 1455906. Many others are also known.

The winding operation itself assumes precise geometrical relationship of the various parts and a precise interface force between the drive roll and the chuck. It will therefore be appreciated that the winding operation and the operation of transferring thread from an "outgoing" to an "incoming" chuck can be very delicate, particularly when handling threads of fine titer and low extensibility. Such threads cannot stretch to accomodate variations in tension, and they commonly have little strength to resist such variations. Accordingly, thread breaks and winding faults are very common when revolver-type machines are used with such threads. To minimise such breaks it is essential to control movements and forces while winding, and to perform the changeover, with minute exactness so that tension variations are reduced to the minimum. This is obviously very difficult to achieve in a machine designed for practical operation under widely varying circumstances as opposed to specific design for a single highly controlled operation.

There is however an increasing demand for machines which are capable of winding fine threads continuously as well as threads of higher titer. Furthermore, there is continuous demand for higher winding speeds when handling all types of synthetic threads.

It is also the currently common practice to drive each chuck by means of a friction drive roller, as in each of the patents referred to above. The roller is rotated about its own longitudinal axis by a suitable drive motor and the rotation of the roller is transmitted to the chuck by frictional contact of the roller surface with the chuck or the surface of a bobbin tube carried by the chuck (at the start of a winding operation) and the surface of a thread package carried by the chuck (after the initial layers of thread have formed on the bobbin tube). The contact pressure applied between the chuck and the friction drive roller, and appearing at the contact surface between the friction drive roller and the package, is a very important feature of any such winding operation because it has a major influence on the quality of the resulting package. All known revolver-systems using friction roller drive therefore involve essentially two main movements -

(1) the revolver rotation to bring the reserve chuck to the winding position and to move the full package out of it, and (2) a relative movement between the chuck in the winding position and the friction roller, which movement both enables package build-up between the chuck and the drive roller and controls the contact pressure.

This second movement can be achieved in principle by movement of the chuck structure relative to a fixed friction roller, or vice versa, or by a combination of movements of both elements.

This "double movement" requirement gives rise to very severe difficulties in adapting the friction driven revolver-type machine to meet current demands. Two movements imply two separate bearing structures. Each bearing structure, in a practical machine, introduces its own "inexactness" into the overall system.

Furthermore, the carrier head itself constitutes a mechanical connection between the two chuck structures, making it extremely difficult to effectively isolate one structure from shocks and vibration on the other. Further, the movements required of the carrier head at particular phases of an operating cycle may be contradictory—for example, the movement of the head to bring a completed package out of the winding position may be in opposition to the movement required to control contact pressure between the new package and the drive roller. In such a case, it is necessary to build complicated counter-moving structures into the system, and this introduces complications into the control system. Further, since it is always necessary to perform certain control functions within each chuck itself, e.g. release and clamping of packages mounted on the chuck, it is necessary to provide complicated rotary connections for control leads extending from the statonary machine frame via the rotary carrier head to each chuck. Suggestions have been made in the past to carry the chucks on individual swing arms, However in most cases this makes no essential difference to the requirement for the "double movement" and in some cases it has led to still more complicated movement paths—see e.g. U.S. specification Nos. 2,789,774, 3,334,827, 2,957,635 and British specification No. 761 689. In many such cases, it was found necessary to incorporate an auxiliary transfer mechanism to transfer thread from an outgoing to an incoming chuck, see e.g. U.S. Pat. No. 3,761,029.

Systems are also known in which each chuck moves towards and away from a friction drive member on an individual predetermined path. One proposal for such a system is shown in U.S. Pat. No. 3,758,042 where each chuck is carried on a respective swing arm. The system is however quite clearly extremely complicated, involving separate friction drive members for respective chucks, and a complicated transfer mechanism for shifting a thread from one chuck to the other upon completion of a package. An alternative arrangement is proposed in outline in U.S. Pat. No. 3,628,741 (Reissue 28514) in which each chuck is movable along a substantially straight guide path into and out of contact with a single friction drive member. However, in this case, the manner in which the thread is to be transferred from one chuck to another is not decribed at all. In apparent developments of this principle in, e.g., U.S. Pat. No.

4,099,680, the principle is shown to be very difficult and complicated to put into practice.

Before leaving the subject of the prior art, brief reference should be made to a large group of prior specifications describing systems in which a plurality of threads are wound simultaneously upon respective chucks. Examples of this group are U.S. Pat. No. 2,869,796 (linear guide systems) and Japanese Published Specification No. 38776 of 1978 (swing arm system). There is no suggestion in these cases that thread should be transferred from one chuck to the other, and there is no possibility of continuous winding of each delivered thread.

It has also been known from U.S. Pat. No. 3,934,830 to construct a spooling mechanism with a servo-mechanism which is a combination of three piston cylinder units with a common cylinder or guide member. However, as above, there is no suggestion of transferring a thread from one chuck to another.

PRESENT INVENTION

It is the primary aim of the present invention to provide a design which is capable of application to machines intended to handle high production speeds and which is nevertheless substantially simpler than machines currently in use in that the "double movement" is eliminated, a single friction drive roller is retained and thread transfer mechanism is eliminated or at least substantially reduced.

The invention provides a winder for thread, particularly but not exclusively synthetic plastics filament, comprising a friction drive member rotatable about a longitudinal axis thereof. A first chuck is movable along a first predetermined path from a rest position to a winding position in which the chuck is driven into rotation about the longitudinal chuck axis thereof by the friction drive member. The first chuck is returnable to its rest position by movement along the first path. A second chuck is movable along a second predetermined path from a rest position to a winding position in which the second chuck is driven into rotation about the longitudinal chuck axis thereof by the friction drive member. The second chuck is returnable to its rest position by movement along the second path. The first and second paths can be so disposed that a thread catching means on a chuck moving along its path towards the friction drive member ("incoming" chuck) can intercept a length of thread extending between the friction drive member and a chuck moving along its path away from the friction drive member ("outgoing" chuck).

In most embodiments of the invention which will be illustrated and further described below, each of the first and second paths is curvilinear, preferably determined by a swing arm upon which the respective chuck is mounted. However, this is not essential. In many circumstances, it may be preferred to provide linear guide tracks along which respective chucks are movable towards and away from the friction drive member. In any event, each chuck may extend cantilever-fashion from the front of a headstock.

The winding position of the first chuck, in which the chuck first comes into driving relationship with the friction drive member during its movement towards the latter, is not necessarily identical with the corresponding winding position of the second chuck. Each such winding position constitutes the end of the respective path adjacent the friction drive member and is referred to hereinafter as the "end winding position" of the respective chuck. Drive contact between a chuck (or a bobbin tube or package carried thereby) and the friction drive member is preferably made within a predetermined zone of the circumference of the friction drive member, referred to hereinafter as the "winding zone". The friction drive member is preferably so located in the machine, and the winding zone is preferably so located relative to the friction drive member, that the longitudinal axis of a chuck in its end winding position lies in or near a horizontal plane containing the longitudiaxis of the friction drive member.

The paths of movement of the chucks may be arranged to intersect immediately in front of the winding zone. The paths of movement of the chucks may be so arranged that the thread catching means on the incoming chuck intercepts the length of thread extending to the outgoing chuck when the incoming chuck is at a location on its path adjacent its end winding position. Normally, it will be preferred to effect the interception when the incoming chuck has reached its end winding position and is in driving relationship with the friction drive member.

However, in some cases it may be desired to pre-accelerate the incoming chuck to a rotational speed higher than that of the friction drive member in order to take up slack which may appear in the thread during the changeover operation. In this case, the incoming chuck may be temporarily stopped on its path shortly before reaching its end winding position, and a changeover may occur during this temporary stop. After changeover, the incoming chuck will complete its movement to its end winding position. In order to provide this temporary stop of the incoming chuck, a movable abutment may be provided against which the incoming chuck, or a part secured thereto, will strike during movement of the incoming chuck towards its end winding position. The abutment may be moved after completion of changeover to release the incoming chuck to complete movement to the end winding position. The distance through which the chuck has to move after the changeover is preferably held as short as practically possible.

A controllable moving means is provided to move each chuck along its path. The preferred form of moving means is a pressure fluid operated means such as a piston and cylinder unit. The longitudinal axis of the friction drive member is then fixed in the machine frame during winding. Build up of a package between a chuck and the friction drive member is accomodated by return movement of the chuck from its end winding position towards its rest position—drive contact with the friction drive member being of course maintained.

The contact pressure applied between the chuck and the friction drive member must be controlled during the winding operation. Preferably this control is effected by control of the moving means, for example by control of the pressurisation of a pressure fluid operated moving means. For a normal winding operation, this control is effected during movement of the chuck over a predetermined portion of its path from the end winding position back towards the rest position. After the chuck has moved through said predetermined portion, the package has reached the desired dimensions and the winding operation is broken off. The moving means is then operated to return the chuck relatively quickly towards the rest position and a changeover operation is initiated as will be further described below.

The rest positions of the chucks preferably lie on opposite sides of a plane containing the longitudinal axis of the friction drive member and passing through the winding zone. As indicated above, such a plane is preferably horizontal or nearly so. Accordingly, in the preferred embodiment, one chuck approaches the friction drive member from above, and the other chuck from below. In both cases, means is preferably provided to compensate for the effect of the weight of a package building up on the chuck, since otherwise this increasing weight of package will lead to undesirable variations in the contact pressure exerted between the chuck and the friction drive member. For each chuck, an individual pressure fluid operated means may be provided controllably to effect movement of the respective chuck towards and away from the friction drive member. Compensation for varying weight of a package on a chuck can be effected by corresponding adjustment of pressure of the pressure fluid medium applied to said fluid operated means. For example, a pressure varying valve in the pressure fluid supply can be adjusted in dependence upon the position of the chuck along its respective path. Such compensation systems are already known, and they comprise in principle a cam surface fixed in the machine and a cam follower movable with the chuck, the cam follower being adapted to adjust setting of the appropriate pressure control valve during movement of the associated chuck along its path.

Where the chucks approach the friction drive member from opposite sides of a plane, as described immediately above, one of the chucks will have a component of its return motion extending in the same direction as the direction of rotation of the friction member, and the other will have a component of its return motion opposed to the direction of rotation of the friction drive member. This is important where, as primarily intended, the invention is applied to a winding machine of the so-called "print friction" type. In this machine type, a thread supplied to the machine contacts the friction drive member at a location upstream from the winding zone considered in the direction of rotation of the friction drive member. After contacting the drive member, a portion of thread travels in contact with the drive member (and as near as possible without movement relative thereto) into the winding zone where it is transferred to a package forming on a chuck. Therefore upon completion of winding of a package, the return movement of the chuck towards the rest position has a varying effect on the wrap angle of the thread around the friction drive member. In the case of one chuck, the return movement will tend to maintain or increase the wrap angle, possibly taking the thread beyond the winding zone considered in the direction of rotation of the drive member; in the case of the other chuck, there will be a reduction of the wrap angle, with the point at which the thread leaves contact with the drive member moving upstream from the winding zone considered in the direction of rotation of the drive member.

In both cases, means may be provided to ensure that a length of thread remains accessible near the winding zone for intersection by thread catching means on the incoming chuck.

For example, in the first case referred to, guide means may be provided to deform the thread path between the drive member and the outgoing package so as to limit the wrap angle of the thread on the drive member.

Whether or not an auxiliary guide means will be required in any particular case depends on several factors, for example

- the path of movement of the outgoing chuck; if this can be changed to reduce movement around the friction drive member and increase movement radially away therefrom, then it is less likely that an auxiliary guide will be required; such a change in the preferred embodiment (chucks approach friction drive member from above and below respectively) implies a lower but wider machine,
- the end winding position of the incoming chuck; the further "downstream" this can be located on the circumference of the friction drive member, the less likelihood that an auxiliary guide will be required;
- the maximum package dimensions required; the larger the required package diameter, the more likely that an auxiliary guide is required,
- the maximum chuck/bobbin dimensions usable on the machine; the larger the chuck/bobbin diameter, the more likely that an auxiliary guide is required.

In most cases it will be preferred to include the auxiliary guide means to assist in achieving a compromise between the partially-conflicting constraints placed on the system as already described.

Where the auxiliary guide means is provided, it may be located above the friction drive member, and may be pivotable about a predetermined pivot axis when moving between a retracted position and an operative position. The pivot axis may be movable towards the friction drive member as the auxiliary guide means is moved towards its operative position, and the pivot axis may be moved away from the friction drive member as the auxiliary guide means is returned to its retracted position.

In the second case referred to above, means may be provided to limit movement of the outgoing chuck away from the friction drive member until after the thread has been intercepted by thread catching means on the incoming chuck; said means or suitable alternative thereto therefore limits the reduction in wrap angle on the drive member, produced by movement of the outgoing chuck towards its rest position, until after thread transfer has been achieved. For example, in this latter case, means may be provided to temporarily halt the outgoing chuck at an intermediate position on its path of movement until after the thread has been intercepted by thread catching means on the incoming chuck.

A temporary halt may be achieved by providing a two stage extensible and retractable means for moving the chuck, the stages being separately controllable. For example, where a piston and cylinder means is provided between a swing arm and a part fixed to a headstock, the piston and cylinder means may comprise a pair of pistons independently movable relative to the cylinder means, one piston being secured to the swing arm and the other being secured to the part fixed to the headstock.

Preferably the cylinder means defines a limited degree of travel for one of the pistons (the "first piston"), thus defining a correspondingly limited degree of travel for the chuck along its path. Means may be provided selectively to prevent relative movement of the other piston (the "second piston") relative to the cylinder means while the first piston is moving through the limited degree of travel. In the preferred arrangement, pressure fluid operated clamping means is provided within the cylinder means to clamp the second piston to the cylinder means while the first piston is moving through the limited degree of travel. Piston and cylinder means including such pressure fluid operated clamping means are commercially available.

The limited degree of travel can be arranged to correspond to the above-mentioned limited movement of the outgoing chuck away from the friction drive member. The control system for the winder can be arranged to cause the first piston to move through the limited degree of travel when winding of thread on the corresponding chuck is broken off. This outgoing chuck is then temporarily held at the position on its path reached upon completion of the limited degree of travel of the first piston until the thread has been intercepted by thread catching means on the incoming chuck. Secure holding of the outgoing chuck in the required position is ensured by the means preventing movement of the second piston relative to the cylinder means, that is, in the preferred embodiment, the pressure fluid operated clamping means. After the transfer of thread to the incoming chuck has been completed, securing of the second piston to the cylinder means is cancelled and the outgoing chuck is permitted to return to its rest position by movement of the second piston relative to the cylinder means.

In the preferred embodiment, movement of the first piston relative to the cylinder means occurs only before and after a winding operation. All movements during a winding operation are effected by movement of the second piston relative to the cylinder means. This division of functions between the two pistons simplifies the requirements on the control system.

In order to support a swing arm in a headstock, a pair of support members may be provided within the headstock, with a shaft extending between and mounted in said support members. A swing arm is mounted on the shaft between the support members for pivotal movement about a longitudinal axis of the shaft, the swing arm carrying one of the chucks at a location spaced from the shaft. Preferably, the location is at the free end of the swing arm.

A second pair of support members, a second shaft and a second swing arm could be provided for the other chuck. In the preferred arrangement, however, the second shaft extends between and is mounted in the same pair of support members as the first shaft. The support members preferably extend substantially vertically from and are secured to a base member of the headstock. The shafts preferably extend substantially horizontally between the support members, the first shaft being located near to the base member and the second shaft being spaced further therefrom.

In the immediately following paragraphs the first chuck mounting, comprising the first shaft and a swing arm carried thereby as defined above, will be described in greater detail. It will be understood that the same arrangements may be applied to the second chuck mounting, comprising the second shaft and the swing arm carried thereby, and these arrangements are preferably applied to both chuck mountings.

Preferably, at least one self-aligning bearing is provided to mount the shaft in one of the support members. Preferably further the bearing is adjustable in position relative to the support members.

The arm preferably comprises a clamping means which clamps rigidly to a non-rotatable portion of the chuck. The non-rotatable portion contains bearings enabling rotation of another portion of the chuck about a longitudinal chuck axis extending substantially parallel to the longitudinal axis of the support shaft.

The swing arm, and the chuck carried thereby, are preferably slidable longitudinally of the support shaft. The reasons for this will become clear hereinafter from a detailed description of the illustrated embodiment. Controllable moving means, preferably pressure fluid operated means, is provided to cause controlled pivoting of the swing arm and the chuck about the shaft axis.

In order to transmit motion from the moving means to the swing arm, an intermediate member is also mounted upon the shaft so as to be pivotable about said shaft axis but fixed against sliding movement relative to the shaft. The moving means is connected to the intermediate member to pivot the latter about the shaft axis, and a slidable connection is provided between the intermediate member and the swing arm to cause the latter to pivot with the intermediate member while leaving the swing arm free to perform sliding movement relative to the shaft. Auxiliary moving means, also preferably pressure fluid operated means, may be provided between the intermediate member and the swing arm to cause the sliding movement of the swing arm on the shaft. The shaft may have a portion projecting cantilever-fashion beyond one of the support members, and the intermediate member may be mounted upon this projecting portion. Preferably, the shaft projects beyond the rearward support member, that is the support member furthest spaced from the free end of the cantilever-mounted chuck.

Preferably, the rotatable portion of the chuck carries a brake disk which engages a brake shoe when the chuck is in its rest position. The brake disk is preferably located rearwardly of the connection between the chuck and its swing arm. Preferably further, the chuck includes an auxiliary drive means operable to rotate said rotatable portion of the chuck before the latter comes into driving relationship with the friction drive member. The auxiliary drive means may comprise an electric motor, the stator being carried by the non-rotatable portion of the chuck secured to the swing arm. This auxiliary drive means may also be disposed rearwardly of the connection between the swing arm and the chuck.

Where the moving means which cause pivoting of the swing arms upon the shafts comprise a pair of extensible and retractable pressure fluid operating means, e.g. piston and cylinder units, the lines of action of the pressure fluid means are preferably crossed; e.g. assuming that the chucks are located one above the other, the pressure fluid means for the upper chuck may act between the base member of the headstock and the swing arm for the upper chuck, and the pressure fluid means for the lower chuck may act between an upper portion of the headstock and the swing arm of the lower chuck. The lines of action of the pressure fluid operated means are preferably substantially aligned with the chucks when viewed longitudinally of the chucks in their rest positions.

The geometry of the system will normally be subject to predetermined constraints. For example, the minimum diameter of the chucks, and hence of bobbin tubes carried by the chucks, will usually be a given factor which is not subject to substantial alteration. The diameter of the friction drive roller may also be given, and not subject to substantial variation. The user of the machine will normally demand the largest possible package diameters within the smallest possible overall machine dimensions. Finally, it is desirable that the path of travel of each chuck between its rest position and its end winding position should be kept as short as possible. Clearly the final machine geometry in any individual case will be a compromise between these various factors, and still further factors may also have an influence. For example, if a full package of maximum dimensions can be removed quickly from the machine after its formation, then the rest positions of the chucks can lie relatively close to their end winding position(s). If, however, there is no provision for rapid removal of a full package after return of a chuck to the rest position, then the latter must be spaced further away from the friction drive member in order to avoid interference between completed packages temporarily "stored" on the chuck in the rest position and new packages forming on a chuck in the winding position. If desired, automatic doffing systems of known types may be used to ensure rapid removal of full packages from chucks in their rest positions.

Whatever geometry is chosen, it will be found that the line of contact between a package and the friction drive member wanders around the circumference of the latter as the chuck bearing the package moves back from its end winding position towards the rest position during the winding operation, i.e. there will be a variation in the wrap angle of the thread around the friction drive roller. Provided a wrap angle of at least 120° is maintained throughout a winding operation, this variation in wrap angle is not believed to introduce any undesirable effects. In the preferred embodiment, the wrap angle is maintained higher than 150° throughout each winding operation.

The invention is applicable to chucks having thread catcher means of existing, well-known types. Suitable thread catchers are shown e.g. in U.S. Pat. Nos. 3,801,038 and 4,106,711. In these patents, the illustrated thread catcher systems are built into the chuck structure. This is not essential. The thread catcher could be incorporated in a bobbin tube upon which a package is formed during the winding operation and which is removed from the chuck with the package and replaced by a new bobbin tube ready for winding of a further package. Further, the thread catcher means shown in the patents referred to incorporate or are associated with thread severing means for severing the outgoing package from the continuously delivered thread. Such severing means are essential, or at least desirable, in the case of strong threads, usually those of high titer. They are not necessary in the case of weaker threads, generally of finer titer, where the thread can be caused to break between the outgoing package and the incoming chuck. For such finer, weaker threads, the thread catching means can also usually be of a simpler construction, e.g. a simple notch extending along a part of the circumference of the bobbin tube may provide an adequate thread catcher for such threads.

It is standard practice in the winding art to provide a traverse mechanism for traversing the thread longitudinally of the axis of the chuck to enable build-up of a package thereon. The traverse mechanism is provided upstream of the friction drive member considered in the direction of travel of the thread. It is also standard practice to disengage the thread from the traverse mechanism during transfer of the thread from one chuck to the other, and to cause the thread to adopt a substantially predetermined position longitudinally of the chuck axis during the transfer process. Mechanisms for achieving this are described, e.g., in U.S. Pat. No. 3,856,222. Such mechanisms can be adopted substantially unchanged for use in winders according to the present invention. It is further known to provide auxiliary guide means to cause the thread to perform a limited movement longitudinally of the chuck during the transfer operation. Such limited movements may be effected in order to bring the thread into operative contact with a thread catching means or a thread severing means or to provide a so called "transfer tail" upon the bobbin tube prior to starting formation of the main package thereon. Such mechanisms are shown in U.S. Pat. Nos. 3,920,193 and 4,019,690. They are also applicable, without substantial alteration, to winders according to the present invention.

For ease of description and definition, reference has been made above to only a single thread. It will be clear to persons skilled in the art that the present invention is not limited to machines adapted for winding only a single thread. On the contrary, filament winders are normally required to handle from one to six threads simultaneously, each chuck being adapted to carry a corresponding number of packages in parallel. The present invention is equally applicable to machines designed to wind a plurality of threads simultaneously. As is also well known in the art, each thread may be composed of a mono-filament or may be a multi-filamentary structure.

A suitable control means, including suitable timing means, must be provided to coordinate the movements of the outgoing and incoming chucks. The changeover operation can be triggered by a suitable signal developed when a package reaches a predetermined size. The control and timing system will then operate to cause movement of the chuck carrying the full packages in the return direction towards its rest position and to cause coordinated movement of the empty chuck towards its end winding position. The same control and timing system will cause operation of the various auxiliary means described above to ensure that an appropriate length of thread is presented to thread catching means on the incoming chuck to enable it to take over the thread for formation of new packages.

SHORT DESCRIPTION OF DRAWINGS

By way of example, embodiments of the invention will now be described with reference to the accompanying diagrammatic drawings in which -

FIG. 1 is a schematic illustration of a winding machine according to the invention, viewed in elevation from the front, FIG. 2 is a diagrammatic elevation of the machine shown in FIG. 1, viewed from the side, FIG. 3 is a diagram illustrating one changeover operation of the machine shown in FIG. 1, FIG. 4 is a similar diagram showing another changeover operation of the machine shown in FIG. 1, FIG. 5 is a view similar to FIG. 1, but omitting certain details and illustrating mechanical means for effecting certain of the principles to be described with reference to FIG. 1, FIG. 6 is a view similar to FIG. 1 of an alternative embodiment, FIG. 7 is a diagrammatic front elevation of a further winder according to the invention, FIG. 8 is a diagrammatic perspective view from the front and one side of a winder according to FIG. 7, with a side plate of the housing removed, FIG. 9 is a diagrammatic side elevation of part of the headstock shown in FIG. 8, FIG. 10 is a section taken on the distorted plane represented by stepped line V—V in FIG. 7, FIG. 11 is a section through one end of a chuck for use in the winder of FIG. 8, FIG. 12 is a section on a reduced scale taken on the plane represented by the line A—A in FIG. 11, FIG. 13 is a section through an auxiliary guide system of the winder of FIG. 8, FIG. 14 is a perspective view from above and one side showing the relationship of the chucks and friction drive roller at one phase of a changeover operation in the winder of FIG. 8, FIG. 15 is a diagram for use in explanation of one possible "geometry" of a winder according to the invention, FIG. 16 is a diagrammatic representation of one piston and cylinder means for the winder of FIG. 7, and associated control circuitry, FIG. 17 is a diagrammatic representation of a second piston and cylinder means for the winder of FIG. 7, and associated control circuitry, and FIG. 18 is a timing diagram for use in explanation of the control circuitry shown in FIGS. 16 and 17.

DETAILED DESCRIPTION OF DRAWINGS

Figure 1:
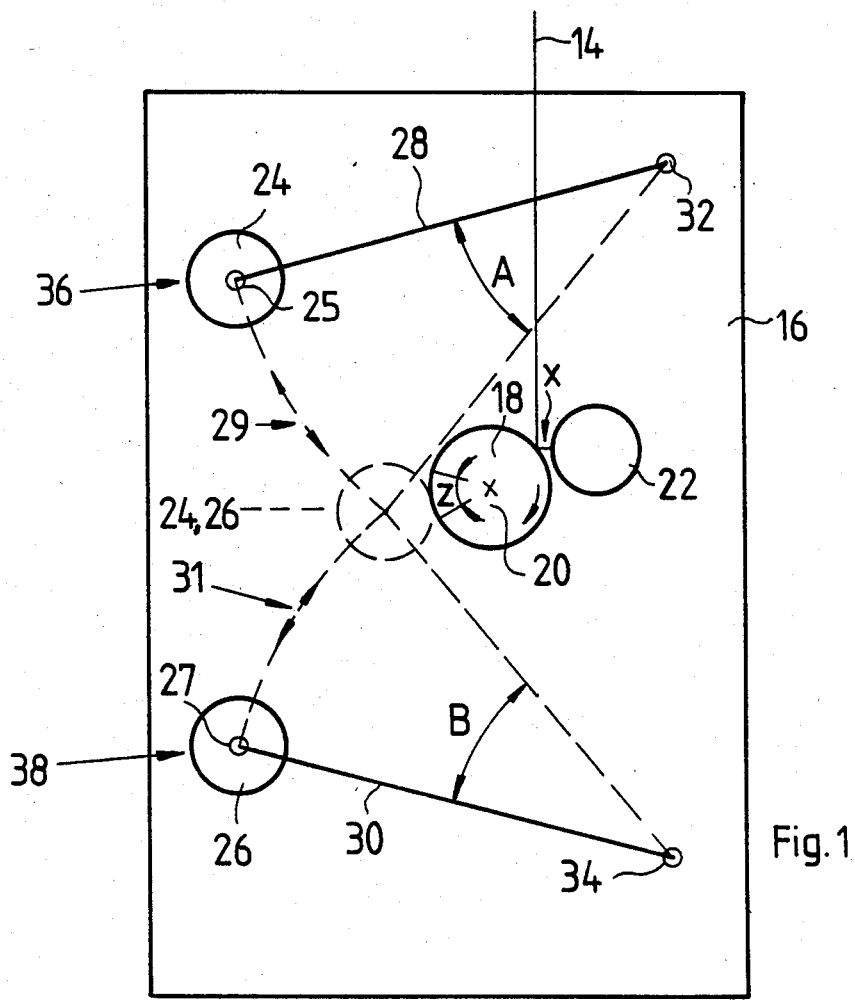
Figure 2:
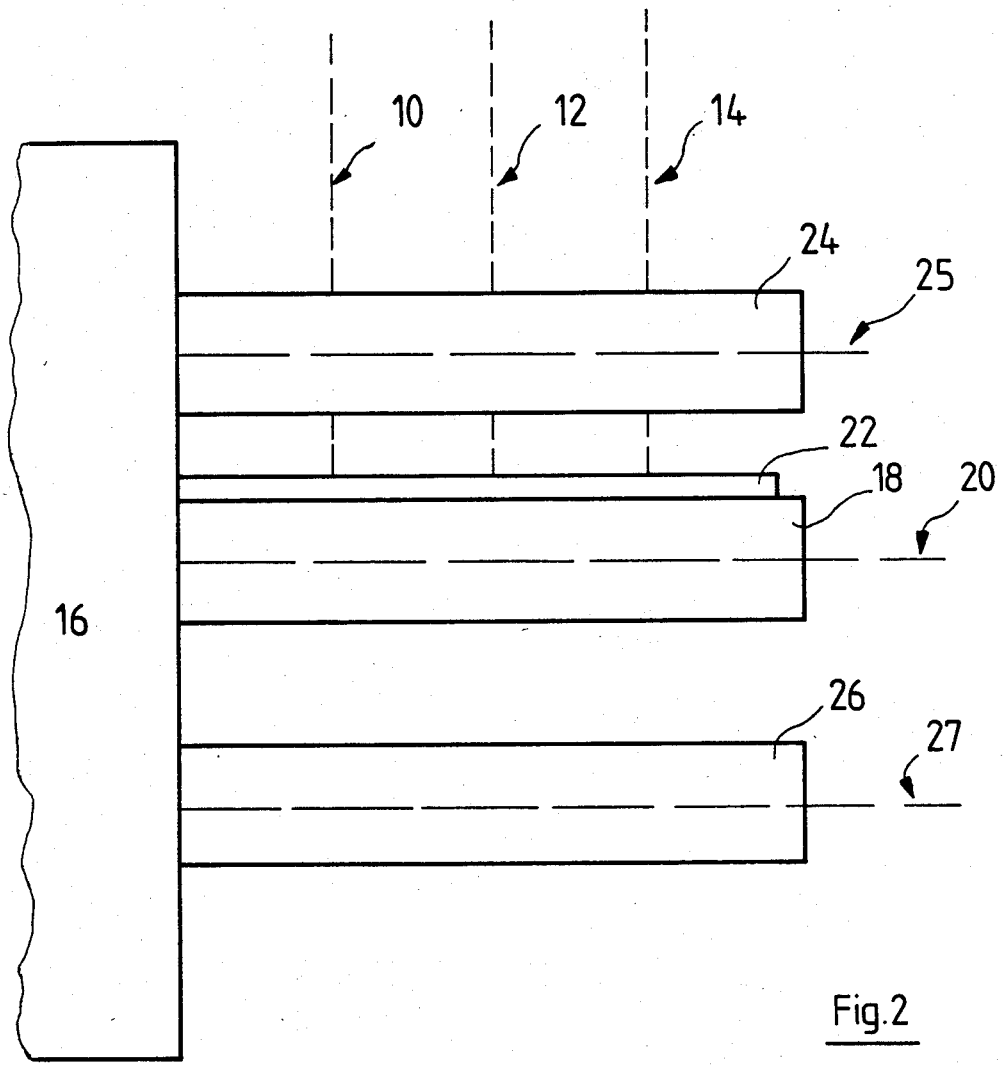

The machine illustrated in FIG. 1 is intended for winding synthetic plastics threads, e.g. textile threads, tire cord, textured carpet yarn. These thread types are given by way of example only, and are not intended to be exhaustive. FIG. 2 indicates three separate thread lines 10,12 and 14. The machine could be designed to handle any other number of thread lines. Each thread may be a mono-filament or a multi-filamentary structure.

In common with other winders intended for handling such threads, the present winder comprises a main housing 16 containing drive motors, bearing systems, electrical, electronic and pneumatic control systems and connection points. The housing together with its operational contents makes up a headstock. Extending cantilever-fashion from the front of the housing is a friction drive roller 18 drivable by a suitable motor (not shown) about its longitudinal axis indicated by dotted line 20. Upstream from the friction roller, considered in the direction of travel of the thread into the machine, is a traverse mechanism 22, also driven by a suitable drive system (not shown) located in the housing 16. For each thread line, mechanism 22 comprises a suitable traverse unit which reciprocates the corresponding thread longitudinally of the drive roller axis. As best seen in FIG. 1, immediately downstream of the traverse mechanism, each thread is laid upon the surface of the drive roller and it travels around the drive roller in contact with the surface thereof until it reaches the portion of the roller circumference indicated at Z in FIG. 1. In this "winding zone" the thread is transferred from the friction roller surface to the surface of a respective package which is forming upon a chuck 24 or 26. The chucks also extend cantilever-fashion from the front of the housing 16, being mounted, by means to be described below, within that housing. The system thus far described is of an already well known type, examples of which can be seen in U.S. Pat. No. 4,283,019. This system differs substantially, however, from the prior art in the manner in which chucks 24 and 26 are mounted and moved towards and away from the friction drive roller 18, and these mounting and moving systems will now be described.

Each chuck 24, 26 is carried upon the free end of a swing arm 28,30 respectively. Arm 28 is pivoted upon a bearing shaft 32 fixed in the upper part of housing 16, and arm 30 is pivoted on a similar shaft 34 fixed in the lower part of the housing. Arms 28 and 30 are each of a fixed length, and pivotable by any suitable means through a predetermined arc A (for arm 28) and B (for arm 30). These arcs may be equal or unequal as required. The uppermost limit of the arc of swing of arm 28 defines a rest position 36 for the chuck 24 which is then spaced from the drive roller 22. The lowermost limit of the arc B of arm 30 defines a corresponding rest position 38 for the chuck 26.

As can be seen from FIG. 2, each chuck 24, 26 extends into the housing 16, and is connected therein to the end of its corresponding swing arm 28,30, the latter arms being located wholly within the housing. The manner in which each chuck is connected to its swing arm is not shown in detail. Each arm must however carry at its free end a bearing structure which supports the chuck while enabling rotation the chuck about its longitudinal chuck axis 25, 27 respectively. Thus, as the swing arm 28 or 30 sweeps out its arc of movement A or B respectively, the corresponding chuck 24, 26 will sweep out an arcuate path of movement, which is represented in FIG. 1 by the lines 29, 31 representing the paths of movement of the chuck axes 25, 27 respectively.

Since the axis 20 of drive roller 18 is fixed in the machine frame, each chuck must move back along its movement path 29, 31 towards its respective rest position to allow a space between the chuck surface and the drive roller 18 as packages build up on the bobbin tubes. This return movement can be controlled by appropriate control of movement of the swing arm 28, 30 respectively. The locations of the shafts 32 and 34 in relation to the axis 20 may be adjusted so that each chuck 24, 26 first contacts the drive roller 18 at substantially the same angular location on the circumference of the roller. This is however, not absolutely necessary.

Before proceeding, it is desirable to explain certain terms used in this specification by direct reference to the drawings—primarily in FIG. 1.

The "wrap angle" is the angle subtended on the axis of the friction roller by radii extending from the axis to the points of first and last contact of the thread with the roller as viewed longitudinally of the roller, said angle containing the portion of the roller circumference contacted by the thread during a winding operation.

The point of first contact of the thread with the roller (as viewed longitudinally of the roller) will usually be substantially fixed for a given winding operation—it is shown at X in FIG. 1.

The point of last contact of the thread with the roller (as viewed along the roller) will change (a) during a given winding operation and (b) immediately thereafter, during changeover.

During a winding operation, the point of last contact of the thread with the roller will lie somewhere within the "winding zone" Z (FIG. 1). The winding zone Z can be viewed as the zone of maximum designed displacement of the point of last contact of the thread with the friction roller for normal winding operations.

At changeover, the point of last contact of the thread with the friction roller may wander outside the winding zone Z as will be further described below.

For reasons which will appear hereinafter, the winding zone Z should extend over only a limited extent of the roller circumference adjacent or, preferably, containing the horizontal plane through axis 20.

In the following description, a changeover operation in which thread is transferred from completed packages on one chuck to bobbin tubes on another chuck will be described. For ease of description, only one thread will be referred to, but it will be understood that the operation is identical for all threads which can be handled simultaneously by the machine.

At or before the lowermost limit of the arc A of arm 28, a set of bobbin tubes carried in use by the arm 24 will engage the surface of the drive roller 18 within the winding zone Z. Rotation of the drive roller 18 in the direction of the arrow shown in FIG. 1 then causes corresponding rotation of the chuck, and thread reaching the winding zone Z is laid upon the bobbin tubes and built into packages. As the packages build up upon the bobbin tubes on chuck 24, arm 28 swings through the arc A in the return direction towards the rest position 36. When a package of desired size has formed on the chuck 24, the rate of movement of the chuck towards the rest position, that is the rate of swing of arm 28 through the arc A, is increased so that a length of thread L (FIG. 4) appears between the full package 40 and the drive roller 18. This length of thread L is made accessible, by suitable guide means to be described below, for interception by thread catching means on the chuck 26 which is then moving towards its end winding position in which it will contact friction roller 18.

Figure 3:
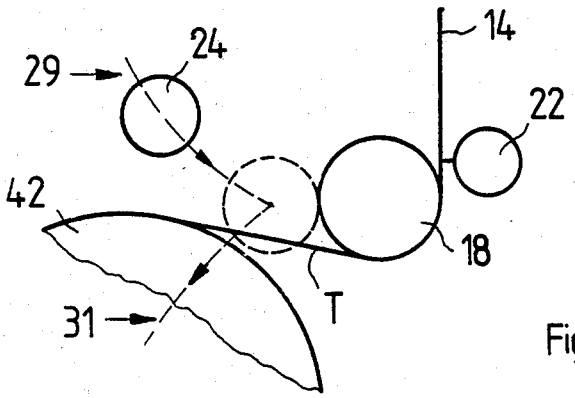
Figure 4:
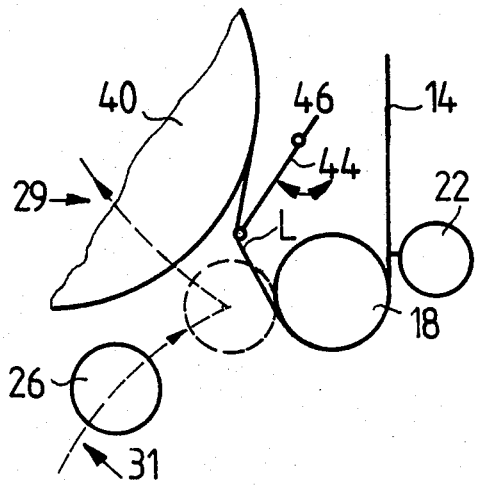

The general arrangement for moving chuck 26 between its rest position 38 and its end winding position is substantially similar to that already described for chuck 24, and further detailed description is believed unnecessary. In the case of chuck 26, a length T of thread extends between the drive roller 18 and the package 42 formed on the chuck 26 as the latter is moved backwards towards its rest position. FIG. 4 shows that the return movement of chuck 24 tends to increase the wrap angle of the thread around the drive member 18 as compared with the normal winding condition in which the package is in driving contact with the drive roller. FIG. 3 shows that the corresponding movement of chuck 26 tends to cause a reduction in the wrap angle. In both cases, it is necessary to ensure that the free length of thread L or T is accessible to the incoming chuck 26 or 24 respectively.

In the case in which chuck 26 is incoming, FIG. 4, the length L of thread is maintained accessible to chuck 26 by means of an auxiliary guide member 44 which is mounted for pivotable movement on pivot axis 46. During a changeover operation, guide member 44 is pivoted in a clockwise direction as viewed in FIG. 4 (by any suitable operating means, not shown) to an operative position shown in the Figure, in which the guide means deforms the thread path between drive roller 18 and package 40. This deformation is such as to decrease or maintain the wrap angle of thread on the drive member 18 and to ensure that thread extending between the guide member 44 and the drive member 18 is readily accessible to the incoming chuck 26. As soon as the changeover operation is completed, member 44 is pivoted in a counterclockwise position about axis 46 to a retracted position in which it does not interfere with any of the normal operations of the machine.

If chuck 24 is incoming, FIG. 3, it is desirable to temporarily halt the movement of chuck 26 along its path back to the rest position 38, thereby restricting the reduction of wrap angle of the thread on the drive member 18 and ensuring that length T remains accessible to the chuck 24. The temporary halt of chuck 26 is maintained until chuck 24 has effectively taken over the continuously delivered thread, and then chuck 26 quickly completes its return movement to the rest position 38.

The actual location of the intermediate position along the path of chuck 26 depends upon the dimensions of the package 42. Allowance must be made for formation of packages of varying dimensions according to the requirements of the user of the machine, and also the machine must be able to cope with fault conditions in which a winding operation must be broken off before completion of the desired package. Thus, the thread length T must be accessible as described over a range of conditions varying from a virtually bare bobbin (for example, a "laboratory package" intended for yarn tests) to a package of the maximum dimensions for which the machine is designed. Accordingly, means, to be described below, is provided to ensure that chuck 26 halts after travelling through a controlled length of its return path after breaking off of a winding operation, regardless of the position of the chuck axis along the path at the time when the winding operation is broken off.

Certain mechanisms designed to put into practice the principles described with reference to FIGS. 1–4 will now be described with reference to FIG. 5. This latter Figure corresponds with FIG. 1, but the front plate of the housing 16 and the parts forward of that plate have been removed to show, diagrammatically, elements within the housing. The drive motor for the traverse mechanism is indicated at 44, and the drive shaft for the friction drive roller 18 is indicated at 46. The pivot shafts 32 and 34 and the swing arms 28 and 30 are also shown. For each arm there is provided a piston and cylinder unit 48, 50 respectively. Unit 48 is pivoted at one end 52 to the housing 16 and at its other end to a projection 54 fixed to or integral with the arm 28. Similarly, unit 50 is pivoted to the machine frame at 56 and to a projection 58 on the arm 30. Extension of unit 48 moves chuck 24 from its rest position to the end winding position, and retraction of the unit causes return to the rest position. Extension and retraction of unit 50 has a similar effect for chuck 26.

It is normally essential to control accurately the contact pressure between a package and the friction drive roller 18. As a package builds up on the chuck 24, the weight of the package will urge the arm 28 in an anticlockwise direction as viewed in FIG. 5, and will tend to increase the contact pressure. This can be compensated by controlled adjustment of the pressure of fluid supplied to the interior of unit 48. Such control can be effected by means of an adjustable pressure reducing valve 60 which is carried by the arm 28 and is provided in a suitable flexible lead (not shown) supplying pressure fluid to the unit 48. The setting of valve 60 is variable in response to a cam follower 62 which is also mounted on the arm 28 to engage a cam surface provided on a cam member 64 fixed in the machine frame.

The shape of the surface on cam member 64 must be adjusted in dependence upon the type of thread being wound and the dimensions of the package required. Thus, for a given thread, the weight of package will be a function of the diameter thereof; the diameter of the package will determine the position of the chuck on its return path, and hence the position of the cam follower 62 on the surface of the cam member 64; the latter elements adjust the pressure in unit 48 in dependence upon package diameter to give the desired contact pressure between the package and the friction drive roller 18. Assume for example, that at the start of a winding operation, when a substantially bare bobbin engages the surface of the friction drive roller, the unit 48 is subjected to internal pressure in one chamber thereof such as to urge the chuck 24 towards the friction drive roller and produce a predetermined contact pressure therebetween. The increasing weight of the package during the winding operation can be compensated by gradually increasing pressure in a second chamber of the unit 48, opposing the initial pressurisation thereof and the weight of the package.

Arm 30 is fitted with a similar compensation system comprising valve 66, cam follower 68 and cam member 70. It will be appreciated, that in this case pressure in the unit 50 must be controlled to urge arm 30 and chuck 26 towards the friction drive roller 18 as the package weight increases. Otherwise, however, the compensation system is essentially the same as that described for arm 28 and chuck 24, and detailed description is believed to be unnecessary.

Figure 5:
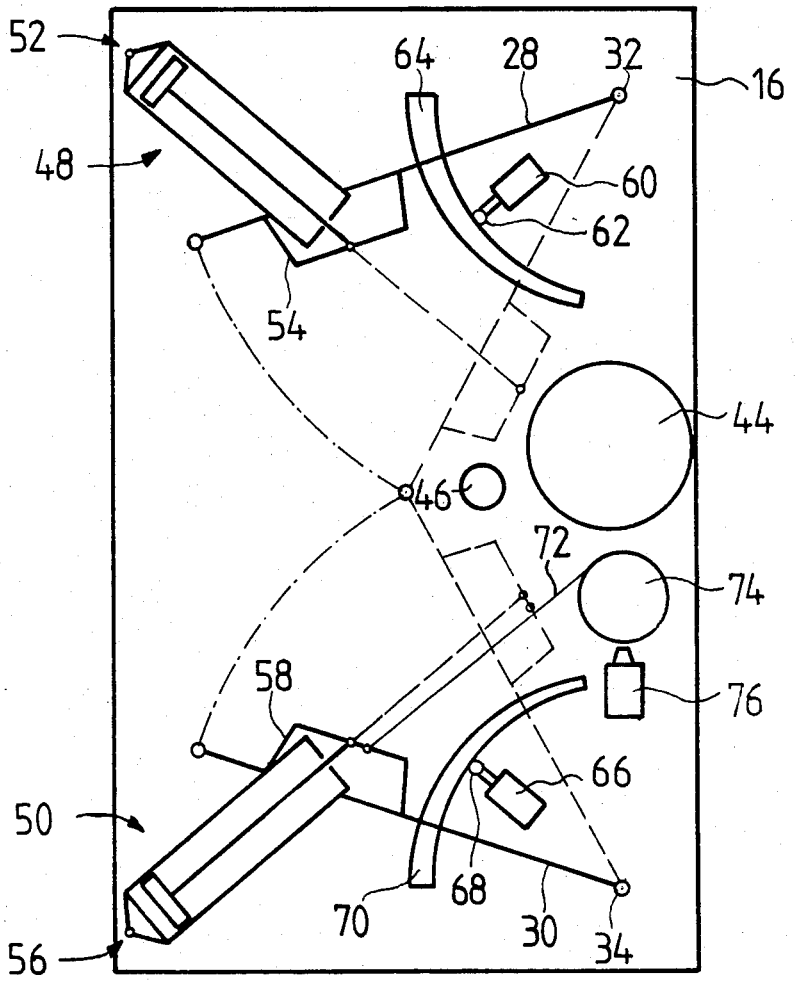

FIG. 5 also illustrates a mechanism for halting chuck 26 after it is moved a substantially predetermined distance along its return path after breaking off a winding operation. This mechanism comprises a flexible element, e.g. a wire 72, which is secured at one end to the projection 58 on arm 30. The wire is wound upon a take up device 74 fixed in the housing 16. Associated with the take up device 74 is a brake mechanism 76 which is triggerable in response to the overall machine control system. When a winding operation is broken off, regardless of whether such breaking off occurs as a result of completion of a package or due to a fault i.e. with an incomplete package, a signal is emitted by the control system and the take up mechanism 74 permits a predetermined length of line 72 to pay out. Simultaneously, the control system will cause unit 50 to withdraw arm 30 in a counterclockwise direction so that chuck 26 moves towards its rest position. When the predetermined length of line 72 has paid out, however, the control system energizes brake mechanism 76 to halt the take up device 74 and thus halt the movement of chuck 26 along its return path. This ensures the production of the required length of thread T as shown in FIG. 3. After a predetermined time, sufficient for completion of a changeover operation by take up of the thread T on the incoming chuck 24, brake 76 is released, and unit 50 is permitted to return arm 30 fully in the counterclockwise direction, thus returning chuck 26 to the rest position.

Figure 7:
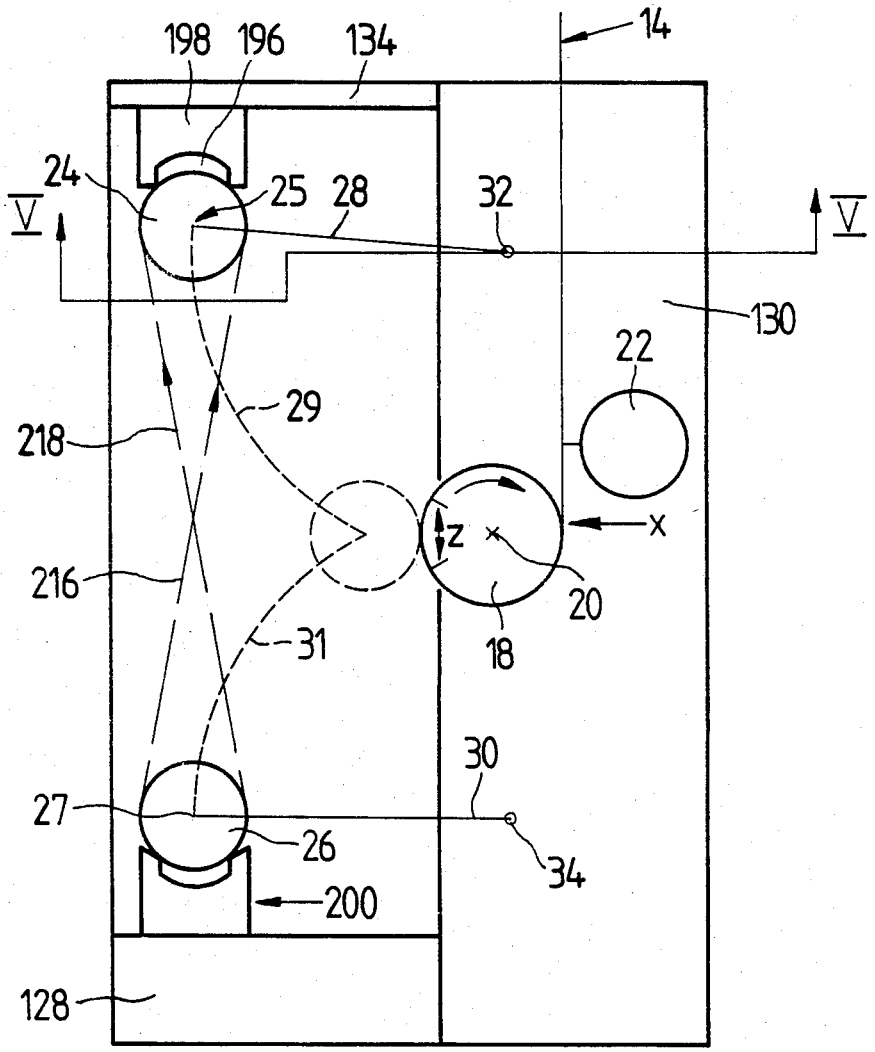
Figure 8:
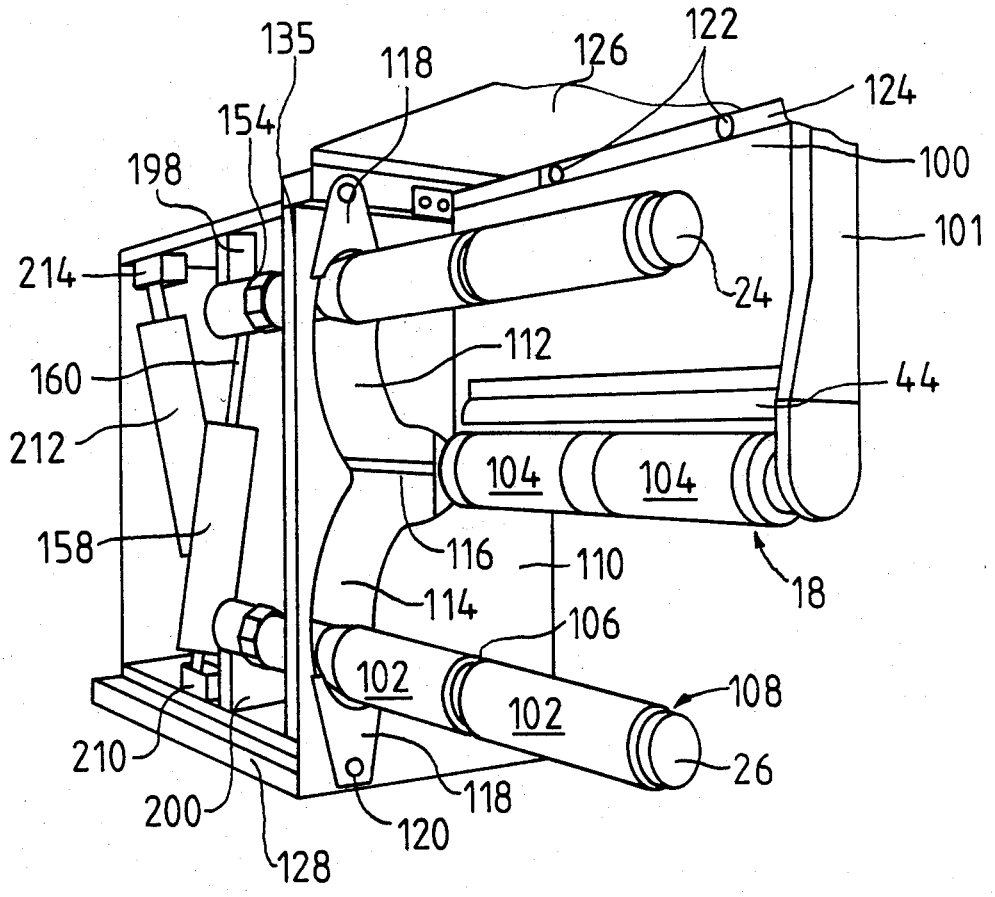
Figure 9:
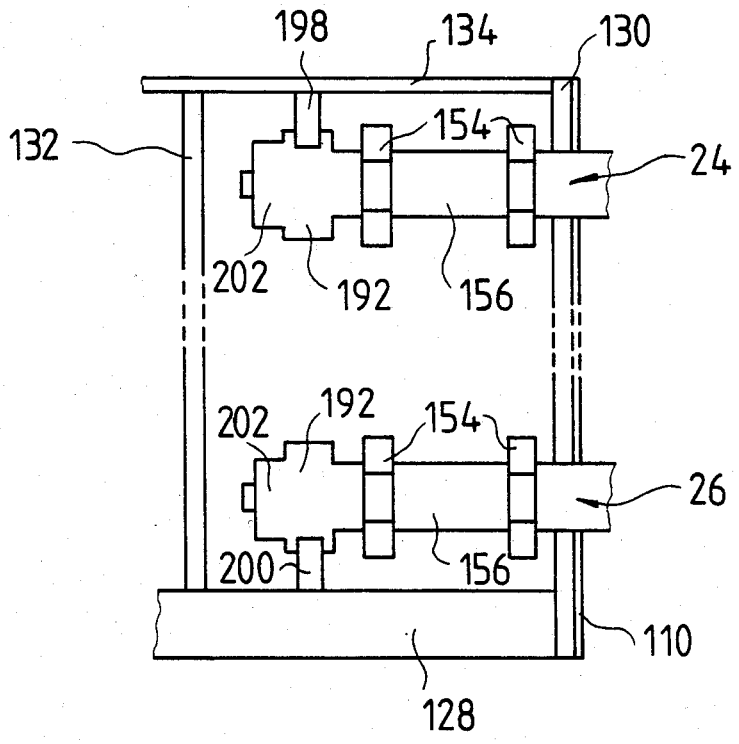

FIGS. 7 to 14 inclusive show a practical embodiment of the invention. As far as possible, the reference numerals used in these Figures correspond with those used in the earlier Figures which were used primarily to explain the novel principles involved. FIG. 8 shows in perspective the relative physical configuration of some of the main elements of the winder. Chucks 24, 26 project cantilever-fashion from the front of a headstock housing 16, the structure of which will be further described below. Friction roller 18 is carried at one end in the head stock housing, and at the other end in a bearing member 100, 101 which also projects cantilever-fashion from the front face of housing 16. The traverse mechanism is hidden behind bearing member 100 in the perspective view. The bearing member 100, 101 can be omitted if desired, the rigidity of the friction roller structure being increased to compensate for the omission of the outboard bearing.

FIG. 8 shows the machine in its non-operating condition, the chucks being illustrated in their respective rest positions. Each chuck is shown carrying two bobbin tubes 102 and the friction roller has two corresponding treated surfaces 104 designed to form a good driving connection with packages building up on the bobbin tubes 102. Each chuck has two thread catching/severing structures, which will not be described in detail in the present application, but which are formed in accordance with U.S. Pat. No. 4,106,711. For chuck 26, one such structure is located in alignment with the gap 106 between the bobbin tubes 102, and the other one is provided at the location 108 outboard of but adjacent to outer bobbin tube 102. The catching/severing structures of the chuck 24 are provided at corresponding locations.

The front face of housing 16 is provided by a plate 110, which provides a mere facing for the front of the machine and is not a load bearing part thereof. Plate 110 has two arcuate slots 112, 114 respectively representing the respective paths of movement of chucks 24, 26. Where these slot converge, the drive shaft 116 of friction roller 18 can be seen extending into the housing 16 to a drive motor (not shown) mounted therein on a rearward support member 132 (FIG. 9) which will be described further below. The generally triangular shaped members 118 are push-out shoes, each of which is reciprocable longitudinally of its associated chuck 24, 26 respectively, by means of a respective operating shaft 120. Each shoe 118 engages behind the bobbin tubes 102 on the associated chuck, when the latter is in its rest position as shown, and can be moved along the chuck to force the bobbin tubes (and packages carried thereby) off the chuck during a doffing operation. This is a standard doffing mechanism, and will not be described in detail herein.

The auxiliary guide 44 used for deforming the thread length L (FIG. 4) can also be seen in FIG. 8. An operating mechanism for this guide will be described below with reference to FIG. 13. Rollers 122, carried on an arm 124 fixed to the bearing member 100 above the friction drive roller 18, are used as will be described below, to assist in manual threading up of the machine when it is first put in operation. A hood 126 extends from the housing 16 forwardly over the operating region in front of that housing.

The main load bearing elements of housing 16 comprise a base plate 128, a pair of upright plates 130, 132 respectively and an upper plate 134 secured to the upper ends of the plates 130, 132. Additional bracing struts, such as 135 (FIG. 8) may be incorporated into the housing as required, but will not be referred to further herein. As best seen in FIG. 7, in which the facing sheet 110 is assumed to be removed, uprights 130, 132 extend across approximately half the width of the machine on the right hand side thereof as viewed from the front. The left hand side of the machine is left free for movement of the chucks and the parts associated therewith.

Figure 10:
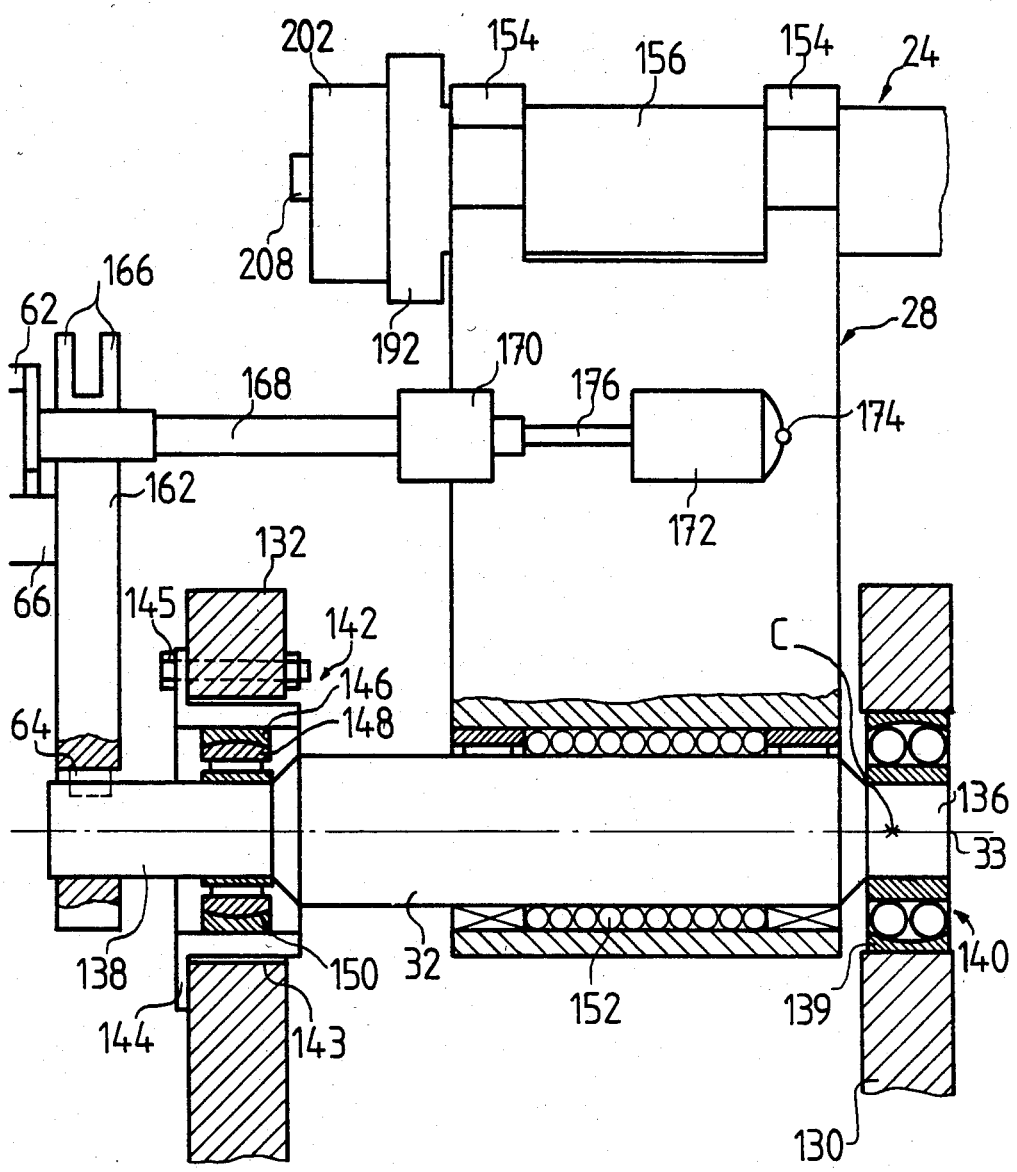

FIG. 10 shows the swing arm 28 and the mounting therefor. It will be understood that the swing arm 30 and the mounting therefor are the same in all important respects. FIG. 10 shows shaft 32 mounted with its longitudinal axis 33 substantially horizontal between uprights 130 and 132. Mounting of the shaft is effected on reduced end portions 136, 138 thereof. A ball bearing unit 140 is provided between shaft portion 136 and upright 130, and is secured to the shaft and to the upright so as to prevent movement of the shaft to the right as viewed in FIG. 10. The outer race 139 of this unit has a part-spherical inner face centred on the point C which lies on the axis 33. Unit 140 therefore permits orientation of axis 33 to lie at any disposition within an imaginary cone (not shown) the apex of which lies at point C.

A roller bearing unit is provided between shaft portion 138 and upright 132, and is secured to the shaft and the upright so as to prevent movement of the shaft to the left as viewed in FIG. 10. Unit 142 comprises a flanged annular support 144 carrying an outer bearing race which is formed in two parts 146, 148 respectively. Parts 146 and 148 contact each other on a part-spherical interface 150 having a center on the axis 33. Parts 146 and 148 are relatively slidable at the interface 150 so as to provide a limited degree of "universal" relative movement of those parts.

Unit 142 is mounted in an opening 143 in upright 132 by means of bolts, such as bolt 145, passing through the flange 144 and the upright 132. Opening 143 has a diameter larger than the external diameter of the cylindrical portion of unit 142 which is located in it in use, and the bolt holes in upright 132 also leave play (not shown) around the bolts. The position of unit 142 is therefore adjustable relative to upright 132 to enable adjustment of the orientation of axis 33 within the imaginary cone described above.

Arm 28 is mounted on shaft 32 between the uprights 130, 132 by means of a ball bearing 152. The dimension of arm 28 longitudinally of shaft 32 is less than the spacing between uprights 130, 132, so that the arm is slidable longitudinally on the shaft 32, for a purpose to be described hereinafter. At its free end, arm 28 carries two clamping jaws 154 which clamp rigidly onto a housing portion 156 of the chuck 25.

Pivoting of arm 28 about the axis 33 is effected by a piston and cylinder unit, the cylinder of which is shown at 158 in FIG. 8 and the piston of which is connected by rod 160 (FIG. 8) to the arm 28 by way of an intermediate member 162 (FIG. 10). Member 162 is mounted on shaft portion 138 which extends rearwardly beyond upright 132 for this purpose. A key 164 is provided between intermediate member 162 and shaft 32 so that member 162 is fixed against both sliding and pivotal motion relative to the shaft. At its free end, member 162 carries projections 166 by means of which a pinned knuckle-joint (not shown) is made with the connecting rod 160.

A rod 168 is rigidly secured at one end to the intermediate member 162 and extends forwardly thereof into a bearing bush 170 secured to the underside of arm 28. Rod 168 is freely slidable within bush 170 as arm 28 slides longitudinally of shaft 32. However, rod 168 secures arm 28 to intermediate member 162 so that both will pivot together about axis 33. The sliding motion of arm 28 on shaft 32 is produced by selective pressurization of an auxiliary piston and cylinder unit, the cylinder 172 of which is secured to the underside of arm 28 at pivot 174 and the piston (not shown) of which is connected by rod 176 and a suitable pin-joint (not shown) to rod 168. The non-slidable intermediate member 162 also carries the cam follower 62 and pressure reducing valve 60 described above with reference to FIG. 1.

Figure 11:
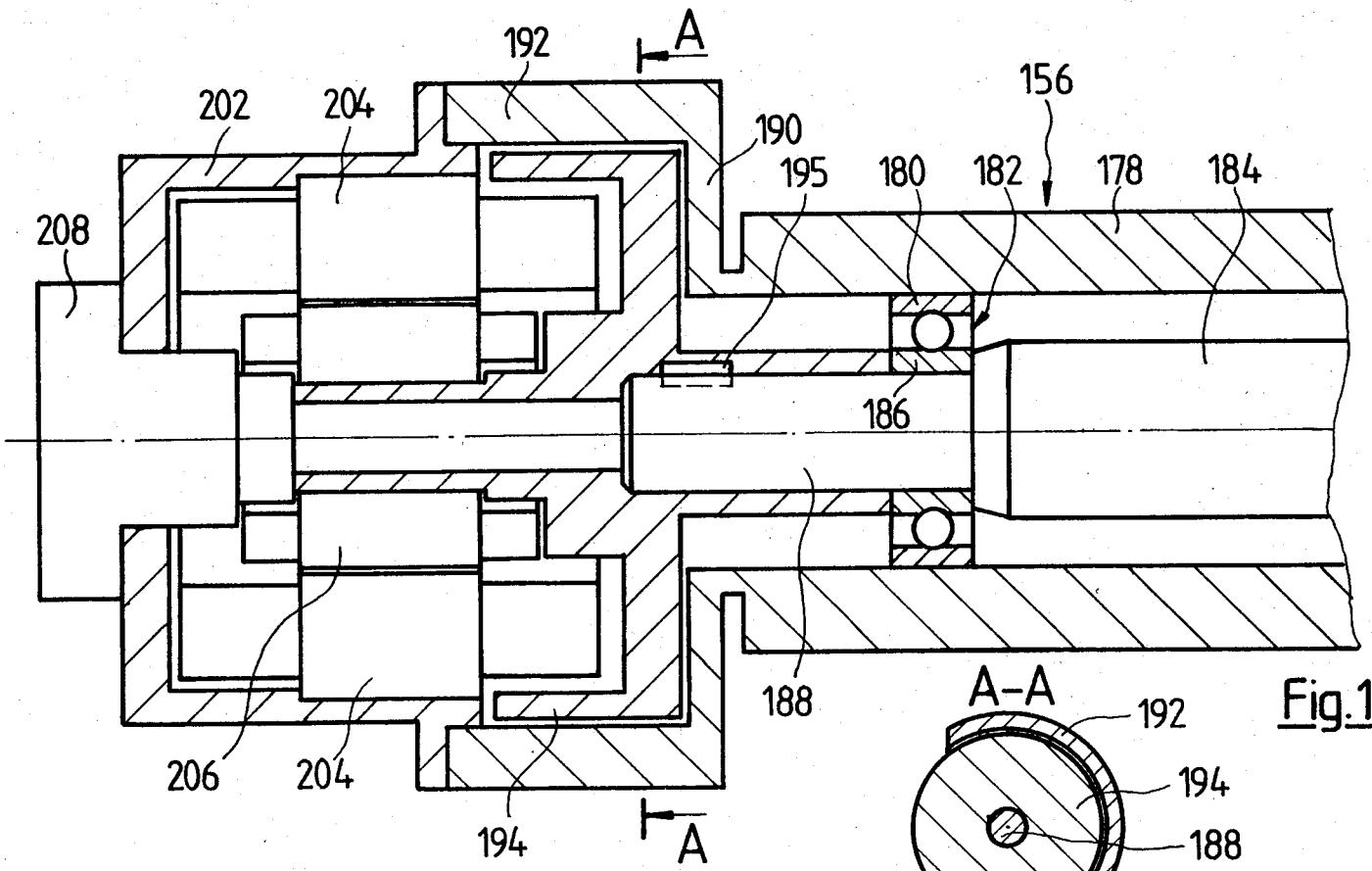
Figure 12:
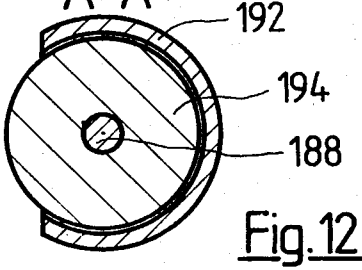

FIG. 11 shows additional detail of the end portion of chuck 24 within housing 16. Again, it will be understood that the corresponding end portion of chuck 26 is the same in all important respects. Chuck housing 156 is shown to comprise a sleeve-like wall structure 178 which is not shown in detail since it forms no part of thus invention. The wall carries the outer race 180 of a ball bearing 182 by means of which a coaxial rotatable portion (shaft 184) of the chuck is mounted in the non-rotatable portion 156. The inner race 186 of the bearing is mounted on a reduced end portion 188 of the shaft. Rearwardly of the jaws 154 wall 178 has an outwardly projecting flange 190 joining a semi-cylindrical portion 192. When viewed longitudinally of the chuck axis 25 (see the reduced scale detail FIG. 12) portion 192 is partially cut away so that brake disk 194 stands radially proud therefrom. Disk 194 is keyed to shaft portion 188 at 195 and is rotatable with the shaft. Where it projects from portion 192, disk 194 engages a brake shoe 196 (FIG. 7) when chuck 24 is in the rest position. Shoe 196 is carried by support element 198 secured to the underside of plate 134 of housing 16. The corresponding structure 200, for chuck 26, is carried by base plate 128 of the housing.

Rearwardly of the brake structure, portion 192 carries a cap 202 fixedly secured thereto. Cap 202 carries the stator windings 204 of an accelerating electric motor, the rotor windings 206 of which are secured to the shaft 184 of the chuck by way of an extension on the brake disk 194. By means of flexible leads (not shown) this motor can be energized after the chuck has been moved away from the brake shoe 196 and before it reaches its end winding position, so that the chuck is accelerated to a desired rotational speed before reaching the latter position. Cap 202 carries a connection socket 208 for flexible leads feeding a pressure medium (pneumatic or hydraulic) to the interior of the chuck structure to operate a bobbin clamping mechanism therein. Since this mechanism is conventional, forming no part of the present invention, it will not be described. Control of supply of pressure fluid via socket 208 can be effected by means responsive to contact of the chuck with the brake shoe, for example as described in U.S. Pat. Nos. 3,701,492 and 4,036,446.

Although not shown in the Figures (since it forms no part of this invention) the rotatable shaft 184 is secured to a rotatable shell rightwardly of the chuck portion shown in FIG. 11. This shell is of approximately the same outer diameter as wall 178 which terminates rightwardly of FIG. 11 to leave space for the shell. The latter provides a package receiving structure and houses the operating parts of the chuck such as bobbin clamping mechanisms. The shell and the other mechanisms are conventional.

Returning now to FIG. 8, the lower end of cylinder 158 is connected to a boss 210 on the base plate 128 by means of a knuckle-joint (not seen). The cylinder 212 of the piston and cylinder unit which operates chuck 26 can also be seen in this Figure, but the rod connecting the piston to the arm 30 is hidden behind cylinder 158. Cylinder 212 is connected to a boss 214 on the underside of plate 134 by means of a knuckle-joint (not seen). The lines of action of these two main piston and cylinder units are represented by the chain dotted lines 216, 218 respectively in FIG. 7. Line 216 represents the line of action of the first piston and cylinder unit to hold chuck 24 in its rest position, the unit being pressurized for this purpose. Line 218 represents the initial line of action of the second piston and cylinder unit as it draws chuck 26 upwardly from its rest position, the unit also being appropriately pressurized for this purpose. Movement of the chucks to the winding position involves in each case a contraction of the associated piston and cylinder unit. The lines of action of these units swing through arcs corresponding with the arcs of movement of their respective chucks 24, 26. It will be seen from FIG. 7, however, that the lines 216, 218 cross when viewed longitudinally of the chucks 24, 26 and are located in general alignment with the chucks when viewed in the same direction.

Figure 13:
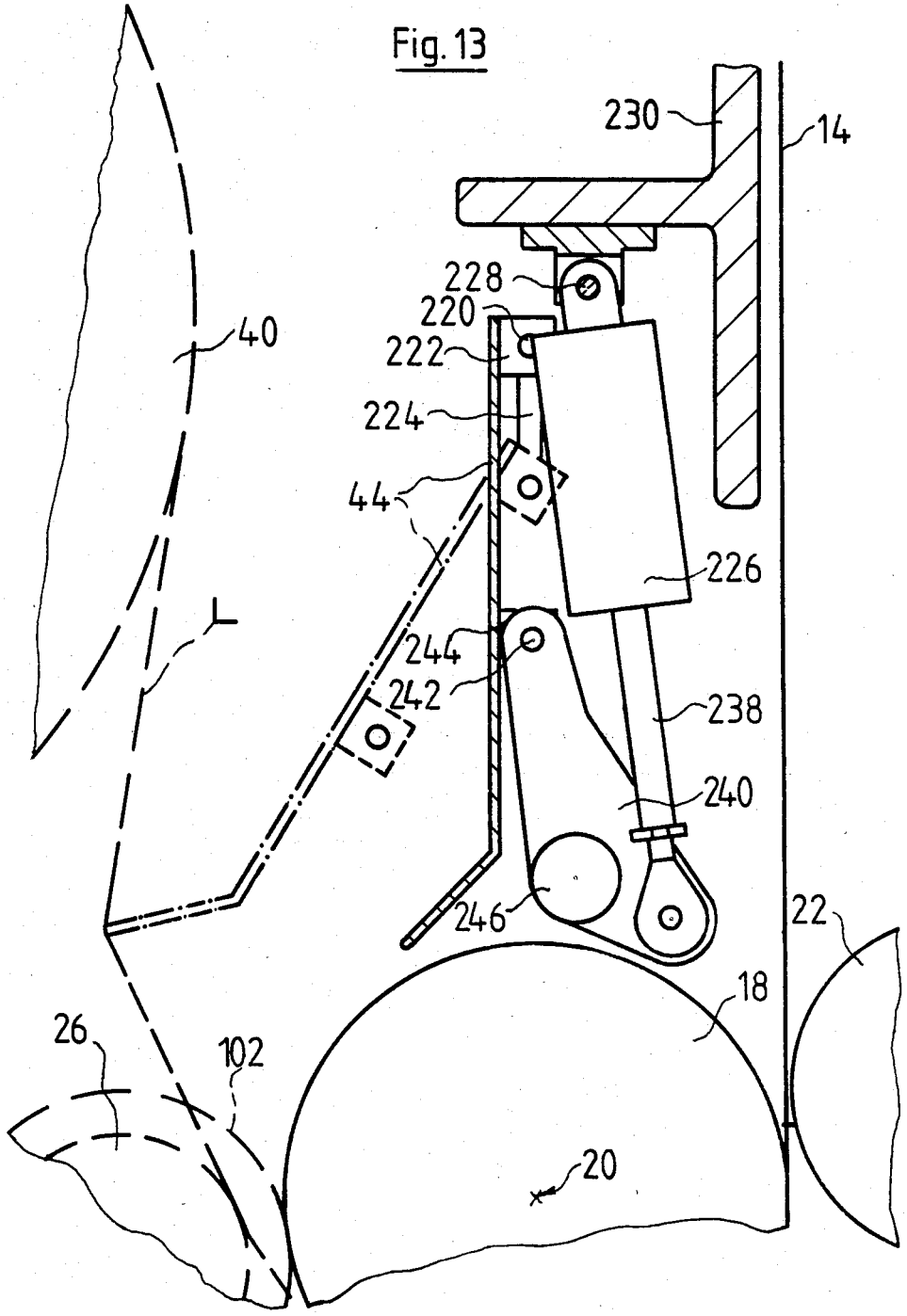

FIG. 13 shows in further detail the operating mechanism for the auxiliary guide 44 shown in FIG. 7 and FIG. 8. The purpose of this mechanism is to move guide 44 between its retracted position (shown in full lines) and its operative position (shown in chain dotted lines). This movement involves a pivotal component occurring in a clockwise direction about the pivot shaft 220 to which guide 44 is secured by means of lug 222. Shaft 220 is itself vertically movable along a guide slot 224 provided, for example, in facing plate 110 or in a part secured thereto. A similar guide slot can be provided upon the member 101 (FIG. 8) at the other end of guide 44. Slots 224 define a path of movement for shaft 220 towards and away from the friction roller 18.

Movement of guide 44 is effected by a piston and cylinder unit, the cylinder 226 of which is pivoted at 228 to a frame member 230 providing part of the bearing member 100. The piston (not shown) is connected via rod 238 to one end of a link 240, the other end of which is pivoted at 242 to another lug 244 secured to guide member 44. Link 240 is pivotable around shaft 246 which extends in a fixed position between housing 16 and the outboard bearing member 101. Extension and retraction of the piston and cylinder unit causes movement of guide 44 between its retracted and operative positions shown in FIG. 13, the retracted position being such that the guide does not interfere with the normal winding operation. Slots 224 may be unnecessary in some machine designs depending upon machine geometry.

Figure 14:
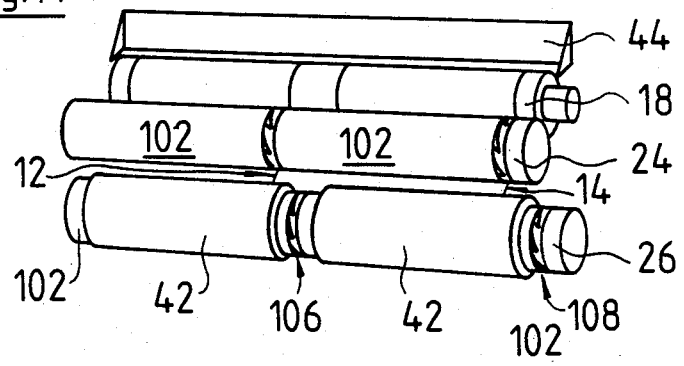

The purpose of the axial sliding of the arms 28, 30 on the respective shafts 32, 34 will now be described with reference to FIG. 14. This shows the catching phase of a changeover operation in which two threads 12, 14 are being transferred from completed packages 42 on a lower chuck 26 to start new packages on an upper chuck 24. Again, only operations on thread 14 will be described, the process being the same for thread 12. During winding of packages on each chuck, that chuck is in its "fully forward" or "extended" position; chuck 26 is shown in this position in FIG. 14. Prior to or upon breaking off winding of packages 42, an auxiliary mechanism removes the thread from its traverse unit of the traverse mechanism 22 so that the thread ceases to traverse longitudinally of the chuck axis 26. The same mechanism locates the thread in a substantially predetermined position relative to the chuck so that the thread overwinds its package 42 at a substantially predetermined location thereon. As described above with reference to FIG. 8, however, the thread catching/severing devices 106, 108 are built into the chuck structure and lie adjacent the ends of the bobbin tubes 102. In order to align these devices 106, 108 with the corresponding threads 12, 14, it is necessary to retract the chuck by an appropriate distance into the housing 16, as shown for the chuck 24 in FIG. 14. In FIG. 10, chuck 24 is shown in its extended position, and it can be drawn leftward into the retracted position shown in FIG. 14 by suitable pressurization of the cylinder 172 (FIG. 10) to force the latter leftward along the rod 176, bush 170 sliding simultaneously leftward along rod 168.

While chuck 24 remains in its retracted position, a further auxiliary mechanism moves the thread through a limited distance longitudinally of the chuck, causing catching and severing of the thread as described in U.S. Pat. No. 4,106,711. Cylinder 172 is then pressurized so as to force it rightward as viewed in FIG. 10, chuck 24 thus moving from the retracted position shown in FIG. 14 to the extended position shown in FIG. 10. Due to axial movement of the auxiliary mechanism together with this axial movement of the chuck, a transfer tail is wound upon each bobbin tube 102, e.g. as described in U.S. Pat. Nos. 3,920,193 and 4,019,690, which latter also describe auxiliary mechanisms for controllably removing thread from the traverse units. The transfer tail is wound on an end portion of the bobbin tube 102 lying beside the normal package traverse. When chuck 24 reaches its extended position, the thread is returned to its traverse unit, and normal winding of a package begins.

In some cases it may also be found useful to form the yarn-contacting edge of guide 44 with yarn-receiving slots, and to shift guide 44 axially of the chuck to assist the axial shifting induced by the auxiliary mechanism referred to above. Thus will give more precise axial location of the thread, but at the cost of added complication.

If the winder is designed to deal with fine threads which break easily, then the catching/severing devices 106, 108 may be omitted and simple slots may be provided in the bobbin tubes 102 as already well known in this art. Each slot catches a thread as the latter is moved over it by the auxiliary mechanism referred to above, and the fine thread breaks between the new bobbin tube and the outgoing package. The auxiliary mechanism may be adapted to wind a transfer tail, and the axial movements of the chucks may then be omitted. The axial movement of the chucks may also be omitted where the winder is intended to deal with strong threads and catching/severing units are built into the chucks, if suitable guiding means are substituted for the axial movement. For example, during a changeover of the type illustrated in FIG. 4, guide 44 may be adapted to hold the upstream portion of thread length L at the desired location on packages 40 while a suitable auxiliary mechanism moves the downstream portion thereof axially of the chuck 26 into alignment with catching/severing devices 106, 108 thereon. An additional guide must also be provided to hold the upstream portion of thread length T (FIG. 3) at the desired location on package 42 in a changeover of the type shown in FIG. 3. It is preferred, however, not to incorporate such guide systems, as control thereof is complex and it is desirable to maintain the space around the friction roller 18 as clear as possible during the changeover operations.

When the machine is first started up after a shut down, it must be threaded manually. The continuously supplied thread will normally be taken up by an air pistol (aspirator) manipulated by an attendant. The thread will be inserted between the traverse mechanism 22 and friction roller 18, that is behind the member 100 shown in FIG. 8. The machine control system will at this stage be placed in a "string up" mode so that auxiliary mechanisms will hold the threads out of the operating region of the traverse mechanism itself. The control system also causes movement of the auxiliary guide 44 to its operative position, and the attendant passes the threads around roller 18, past the guide 44 and onto respective guide rollers 122 (FIG. 8). Upon pressing of a start button, the machine now operates automatically to carry out a "changeover" of the type illustrated in FIG. 4, that is, with the lower chuck 26 moving from its rest position into its end winding position and taking up the length of thread between guide 44 and friction roll 18. The severed threads, most of which extend upstream from guide 44 to the guide rollers 122, is taken up by the aspirator. The winding operation now proceeds normally, and further changeover is effected automatically as already described. It is not essential to start up the machine after shut down by using the lower chuck to take up a thread length. However, it is normally necessary to provide additional guides to assist the attendant to locate the thread in the desired position for initial take up by one of the chucks. In the present case, the auxiliary guide 44 is already available and can be used for this purpose, and the additional guide rollers 122 can be conveniently located under the machine hood 126 where they do not interfere with operations in the "working zone" of the machine.

Axial shifting of the thread by means of guide 44, as briefly mentioned above, can prove especially useful in the string-up operation where thread vibration can be caused by the air pistol.

Figure 15:
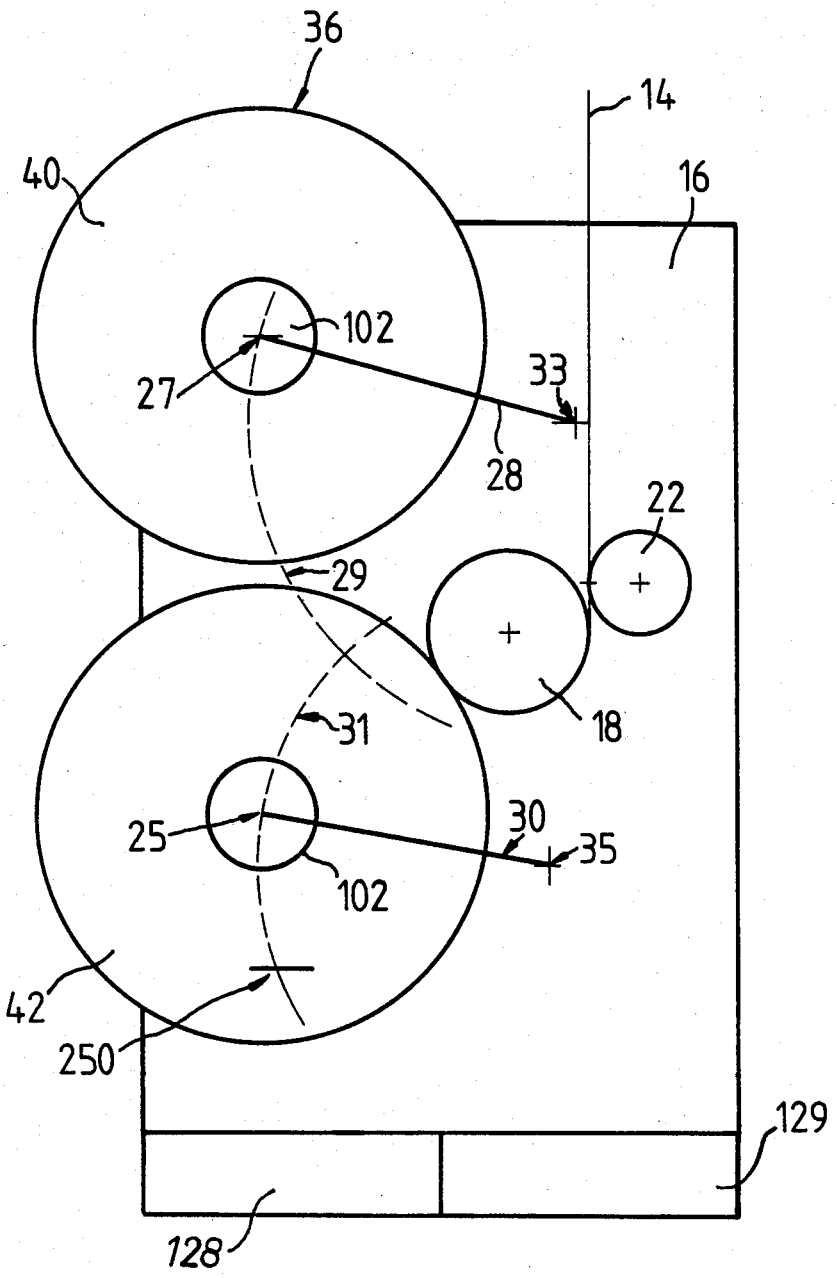

As indicated in the introduction to this specification, the detailed geometry of any particular system will be heavily dependent on the constraints which are placed upon that system. By way of example, however, FIG. 15 shows to scale a "geometry" suitable for a machine of a particular type. In design of this machine, it is assumed that the user may not have automatic doffing equipment available. Further, it is assumed that the machine attendants may not be available "on call" to remove full packages from the machine. Accordingly, the machine is designed to store a full package of maximum dimensions in either the upper or the lower rest position without interference with a winding operation forming a full package of maximum dimensions on the other chuck. There must also be no interference with return movement of the other chuck to its rest position. If the package on the first chuck has not by then been removed, the machine will shut down automatically. There is, of course, nothing to prevent an automatic doffing mechanism being applied to the winder shown in FIG. 15 despite its "storage" ability.

The reference numerals used in FIG. 15 correspond with those used in the other Figures. The part indicated at 129 is a balance foot projecting forwardly from the housing 16 on the right hand side thereof as viewed from the front. The balance foot is omitted on the left hand side in order to leave room for a full package of maximum dimensions in the lower rest position.

The machine is illustrated at the completion of winding of a full package on the lower chuck, a full package being "stored" in the rest position 36 on the upper chuck. The rest position of the lower chuck lies immediately below rest position 36, the axis of the lower chuck then lying at the intersection of the path 31 with the horizontal line 250 in FIG. 15. The following dimensions are given by way of example only—

| | |
|---|---|
| width of casing 16 | 465 mm |
| height of casing 16 | 810 mm |
| max. package diameter | 370 mm |
| external diameter of bobbin tube | min. 81 mm<br>max. 120 mm |
| external diameter of friction roll | 116 mm |
| distance between pivot axis 33 or 35 to chuck axis 25 or 27 | 250 mm |
| maximum projection of full package on upper chuck above machine frame | 85 mm |
| maximum projection of full package on either chuck to side of machine with chuck in rest position | 105 mm |
| wrap angle on friction roll at start of winding on upper chuck | 170° (bobbin diam. 85°) |
| wrap angle on friction roll at completion of winding of full package on upper chuck | 211° (bobbin diam. 85°) |
| wrap angle on friction roll at start of winding on lower chuck | 180° (bobbin diam. 85°) |
| wrap angle on friction roll at completion of winding of full package on lower chuck | 150° (bobbin diam. 85°) |

It is to be noted in particular from FIG. 15 that the paths 29, 31 cross immediately in front of the winding zone on friction roller 18. This has the advantage of enabling varying chuck and bobbin diameters to be used on the same basic machine design. It also helps to ensure that the wrap angle on the friction roller is maintained above the required minimum value throughout winding of a full package on the lower chuck.

In adapting the geometry to varying situations, it is desirable to keep the angle of swing of each arm as short as possible, and hence to make each swing arm as long as possible. For reasons of economy, the upper and lower swing arms should be as near identical as possible, so that parts of the same design can be used for both. The overall geometry will in practice be subject to the requirement to maintain the machine dimensions as small as possible, since this is a normal requirement of users of this type of machine.

It will be clear from FIG. 15 that the winding zone on the friction roller must include the horizontal plane through the roller axis. In principle, the winding zone could be located on the underside of the roller (include the vertical plane through the roller axis). However, a cantilevered chuck tends to bend along its length as package weight increases, especially when a long chuck is used. Location of the winding zone to include the horizontal plane lessens the effect of this bending on drive contact between the roller and package.

A particularly suitable form of piston and cylinder assembly for operating the swing arms will now be described with reference to FIGS. 16 to 18. Again, the same reference numerals have been used as far as possible.

As described above, each chuck structure 24,26 preferably includes an accelerating motor for driving the chuck to a desired rotational speed after it leaves its rest position and before it arrives in its end winding position. Preferably, each chuck is temporarily halted on its path of movement towards the end winding position while the accelerating motor is operated to drive the chuck to the required speed. Accordingly, the complete operating cycle for each chuck can be summarized as follows—

Lower Chuck (26)

1. Move off brake structure 200 to accelerating position.
2. Chuck retracted while in accelerating position.
3. Rapid movement from accelerating position to end winding position (auxiliary guide 44 is moved simultaneously to its operative position—FIG. 4).
4. Chuck moved to extended position (the auxiliary guide for forming the transfer tail is operated just before this).
5. Return movement from the end winding position corresponding with build up of a package on the chuck ("winding operation"—contact pressure between package and friction drive roller 18 must be controlled).
6. Rapid return movement through a limited portion of path 31.
7. Temporary halt while thread transferred to upper chuck.
8. Rapid return to rest position.

Upper Chuck (24)

1. Move off brake to accelerating position.
2. Chuck retracted while in accelerating position.
3. Rapid movement to end winding position.
4. Chuck moved to extended position (the auxiliary guide for forming the transfer tail is operated just before this).
5. Return movement corresponding to build up of package on the chuck ("winding operation"—contact pressure between package and friction drive roller 18 must be controlled).
6. Rapid return movement to accelerating position (auxiliary guide 44 is moved simultaneously to its operative position—FIG. 4).
7. Rapid return movement to rest position.

Figure 16:
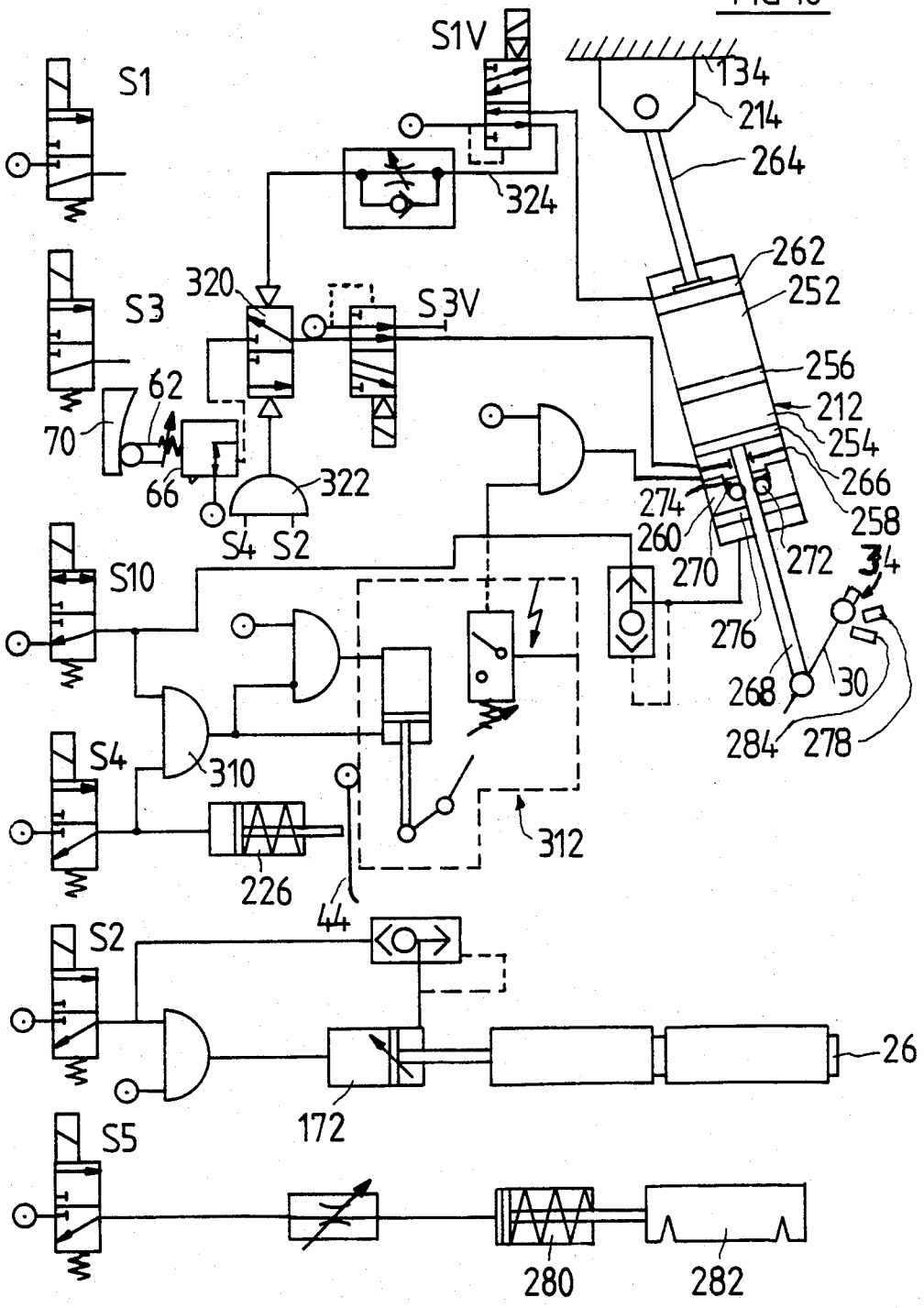

FIG. 16 shows the piston and cylinder means which operates the lower chuck 26 by acting (indirectly) upon the swing arm 30. The cylinder means 212 comprises two chambers 252 and 254 respectively separated by a partition 256 fixed relative to the cylinder. Chamber 252 is bounded at its upper end (remote from partition 256) by the end wall of the cylinder. Chamber 254 is bounded at its lower end by a second partition 258 which is also fixed relative to the cylinder. An auxiliary chamber 260 is defined between partition 258 and the lower end wall of the cylinder.

A piston 262 is reciprocable in chamber 252 and is connected by rod 264 and knuckle-joint 214 to the under side of plate 134. A piston 266 is reciprocable in chamber 254 and is connected by the rod 268 to the swing arm structure 30.

Rod 268 passes through auxiliary chamber 260. Located within chamber 260 and encircling rod 268 is a clamping means in the form of a frusto-conical wedging member 270, having a wedging surface tapering towards the lower end wall of the cylinder. Wedging member 270 is firmly fixed to the cylinder. A plurality of balls 272 is located between member 270 and rod 268. The balls can be acted upon by either of two clamp operating pistons 274 and 276 respectively. Since the operation of this clamp forms no part of the present invention, being a commercially available article, the details of the manner in which clamping pistons 274 and 276 act upon balls 272 are not illustrated or described. However, when piston 274 is operated to urge balls 272 towards the lower end wall of the cylinder, rod 268 will be clamped rigidly to the cylinder. On the other hand, when piston 276 is operated to move balls 272 away from the lower end wall of the cylinder, rod 268 and hence piston 266 will be free to move relative to the cylinder.

Clamping mechanisms of the type generally shown in FIG. 16 are available from Wabco Westinghouse GmbH of Hannover, Germany and are described in German published patent application (Auslegeschrift) 2616973. An alternative device for the same purpose is available from Robert Bosch GmbH, Stuttgart, Germany. Earlier versions of such a clamp are shown in British Patent Specification No. 898260 and German Patent Specification No. 680090.

FIG. 16 also illustrates valves and relays of a control means suitable for controlling pressurization of the piston and cylinder means by a pressure medium from a suitable source to carry out the operating cycle for chuck 26 described above.

In the following paragraphs, the operation of the piston and cylinder means and the control circuit of FIG. 16 will be described with simultaneous reference to the timing diagram of FIG. 18. The operation is described as from start up of the machine, that is, both chucks are assumed initially in the rest positions illustrated in FIG. 7. The piston and cylinder means of FIG. 16 is then in the fully extended condition shown in that Figure. Both chambers 252 and 254 are de-pressurized and the clamping mechanism is inoperative, so that piston 266 is free to move relative to the cylinder.

Before the machine can be started up, however, relay S0 (FIG. 17) must be operated (by manual operation of a button on a control panel—not shown) to pressurize cylinder 316 thereby releasing mechanical safety clamps 318 which otherwise prevent movement of chucks 24,26. Clamps 318 are automatically biased to their operative positions. Relay S0 remains operated until the machine is shut down once again (at time T21 shown in FIG. 18).

Relay S1 (FIG. 16) controls operation of valve S1V to pressurize and exhaust the upper portion of chamber 252, that is the portion above piston 262. When this chamber portion is pressurized, the cylinder is moved upwards relative to the fixed piston 262 until the latter engages partition 256. This corresponds to the movement of chuck 26 away from its rest position into its acceleration position (when piston 262 engages partition 256). Reference to the timing diagram in FIG. 18 shows that the above described movement of chuck 26 to its accelerating position is the first major step (starting at time T1) in start up of the machine. Relay S1 and the other relays, which will be described below, are operated in a timed sequence under the control of a suitable clock means (not shown) the timing sequence beginning with operation of relay S0 at time T0.

The arrival of chuck 26 in its accelerating position is registered by a position sensor 278 (FIG. 16) which actuates the acceleration motor built into the chuck 26 as already described above. Furthermore, relay S2 is operated by the timing system at time T2 to pressurize cylinder 172 (also illustrated in FIG. 10) to retract chuck 26 towards the headstock.

After allowing sufficient time for acceleration of the chuck, the timer operates relay S3 at time T3, and this relay in turn operates valve S3V to pressurize the lower portion of chamber 254, that is the portion beneath piston 266.

The clamping system is in its release condition, so that piston 266 is driven upwardly relative to the cylinder, thereby drawing the chuck into its end winding position. Simultaneously with operation of relay S3, relay S4 is operated to pressurize cylinder 226 (already described with reference to FIG. 13) thereby moving auxiliary guide 44 to its operative position (see FIG. 4).

When chuck 26 has arrived in its end winding position (time T4), relay S3 drops out, permitting valve S3V to switch to a condition in which pressurization of the lower portion of chamber 254 is controlled via the adjustable pressure reducing valve 66. As already described with reference to FIG. 5 and FIG. 10, the instantaneous setting of valve 66 is determined by a cam-follower 68 which engages a cam 70 fixed in the machine headstock, so that movement of swing arm 30 along its return path will be accompanied by movement of cam-follower 68 along cam 70, thereby continuously adjusting the setting of valve 66 and pressurization of the lower portion of chamber 254. This varying pressurization of chamber 254 compensates for the increasing weight of the package building up on chuck 26 during the winding operation and enables the achievement of a controlled contact pressure between the package and friction drive roller 18. Such compensation systems are conventional in this art, and do not per se form part of the present invention. Valve 66 is connected in circuit with valve S3V at time T3 by operation of switch 320 in response to operation of AND gate 322 which is connected (by means not shown) to relays S4 and S2. Switch 320 remains in this set condition until reset via line 324 as will be described later.

At the time of switching of valve S3V, relay S5 is operated to pressurize cylinder 280 thereby moving transfer tail guide 282 longitudinally of the chuck axis. Guide 282 first moves the thread 14 into engagement with the catching/cutting zone on chuck (as already described with reference to FIG. 14) and then begins formation of a transfer tail between the catching zone and the region upon which the final package will be formed. During this latter stage of the movement of guide 282, that is during formation of the transfer tail, relay S2 drops out at time T5, causing pressurization of cylinder 172 to move the chuck 26 to its extended position. Formation of a transfer tail by joint movement of an auxiliary guide and of the chuck is described, for example, in our prior U.S. Pat. Nos. 3,920,193 or 4,019,690.

Chuck 26 is now (time T6) ready to begin winding of a package, and relays S4 and S5 also both drop out. Auxiliary guide 44 returns to its non-operative position, under the bias of a spring provided in cylinder 226, and transfer tail guide 282 returns to its starting position (to the left in FIG. 16) under the influence of a spring provided in cylinder 280. As the winding operation proceeds, chuck 26 moves gradually back along its path 31 (FIG. 7) towards its rest position, contact being maintained between the package building up on the chuck and friction drive roller 18. Piston 266 moves correspondingly downwardly in its cylinder.

When a desired length of filament has been wound into a package on chuck 26, the winding operation is broken off. The control of the length of filament wound into a package is independent of the system shown in FIG. 16. Length measuring devices are well known in this art, and will not be described herein. The length measuring system can be initiated, for example, by a position sensor 284 (FIG. 16) located adjacent the pivot mounting 34 of swing arm 30. The length measuring system will normally be adjustable, so that the user can determine the size of package built up during the winding operation. The piston 266 may therefore be at any of a number of different positions along the cylinder at the time of breaking off the winding operation, the particular position being dependent upon the size of package chosen by the end user.

Up to this point, only the start up of the machine has been described—chuck 24 remains in its rest position. The take up of thread by the lower chuck 26 is in accordance with the diagram of FIG. 4, but the thread is passed manually from friction drive roller 18 over the auxiliary guide 44 during the start up stage. When winding of the first package on chuck 26 is complete, the winder will operate automatically to transfer the filament to the chuck 24. Accordingly, prior to breaking off winding on chuck 26, the length measuring system must initiate certain preparatory operations on chuck 24. The piston and cylinder means which moves chuck 24, and its corresponding control system, will therefore now be described with reference to FIGS. 17 and 18.

Figure 17:
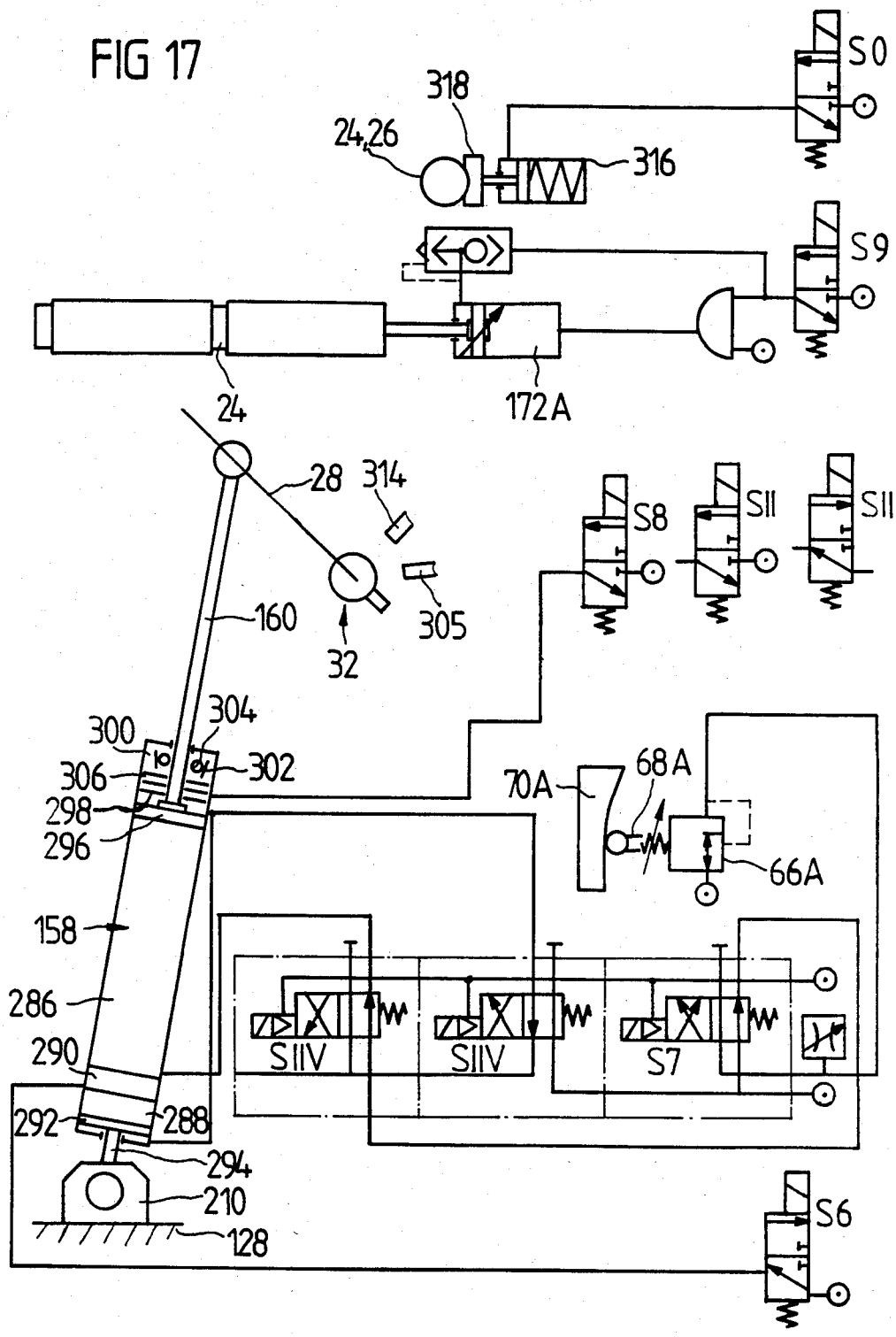
Figure 18:
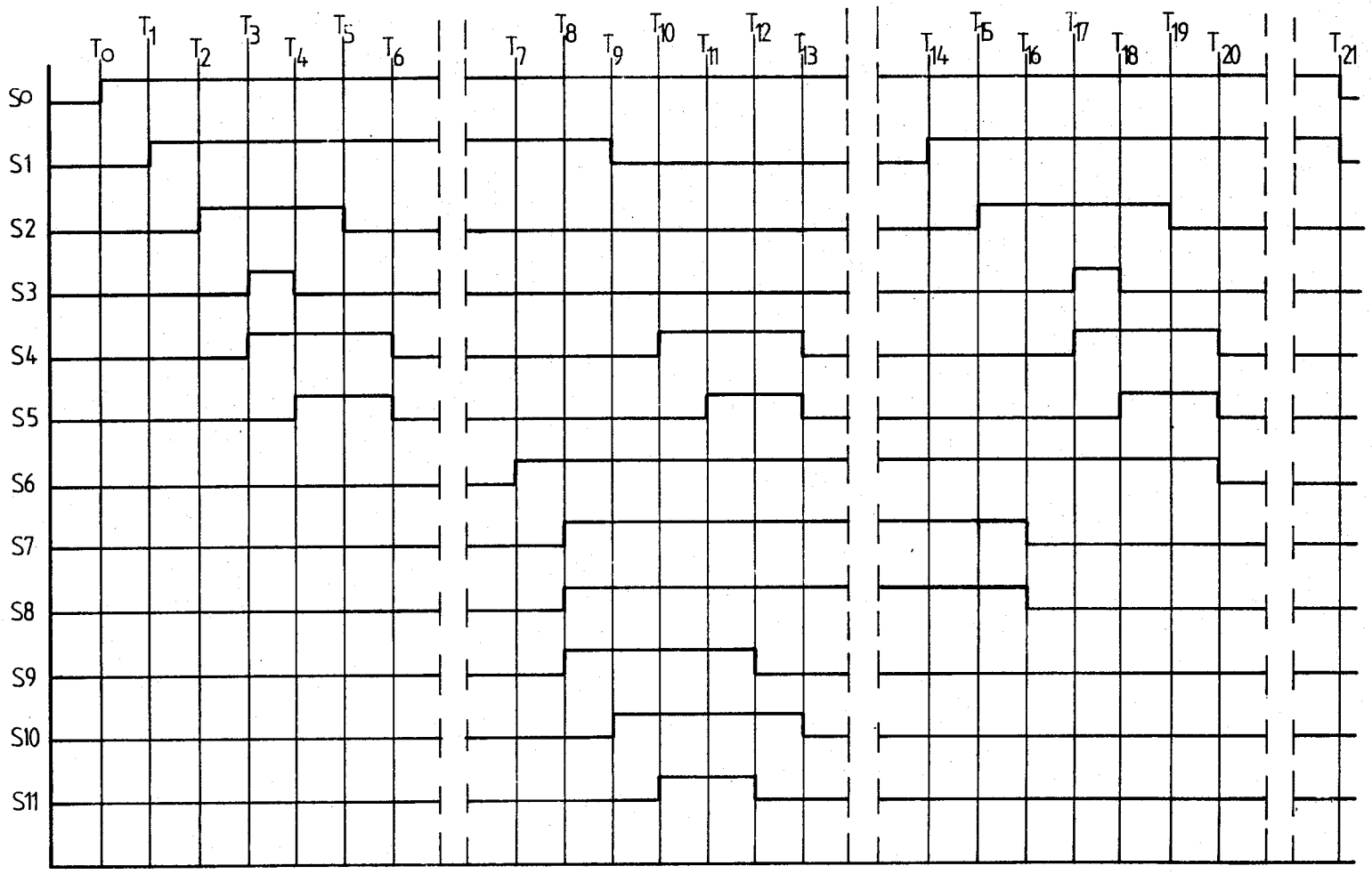

The cylinder means 158 shown in FIG. 17 also comprises two chambers 286 and 288 respectively, separated by a partition 290 fixed relative to the cylinder. A piston 292 is reciprocable in chamber 288, and is connected by a rod 294 to a knuckle-joint 210 on the base plate 128 of the headstock. A piston 296 is reciprocable in chamber 286 and is connected by a rod 160 (also described with reference to FIG. 8) to the swing arm structure 28.

Chamber 288 is bounded at its lower end (remote from partition 290) by the lower end wall of the cylinder. Chamber 286 is bounded at its upper end by a second partition 298 which is also fixed relative to the cylinder. An auxiliary chamber 300 is defined between partition 298 and the upper end wall of the cylinder.

Auxiliary chamber 300 contains a clamping means or system similar to that already described with reference to FIG. 16, but substantially simpler. The clamping system comprises a wedging member 302, a plurality of balls 304 and an auxiliary piston 306 for releasing the clamping effect of the balls 304 around rod 160. The system is such that the clamp is automatically effective unless piston 306 is specifically operated to release it. This is a safety measure to ensure that the upper chuck 24 cannot simply fall under its own weight against friction drive roller 18 in the absence of pressurization of the chamber 286.

During winding of packages on chuck 26, the piston and cylinder means shown in FIG. 17 is in the fully extended condition there illustrated. Chambers 286 and 288 are pressurized, so that the cylinder is in its raised position relative to the fixed piston 292, and piston 296 is in its fully raised position relative to the cylinder. The first step in preparation of chuck 24 prior to breaking off winding on chuck 26 is the operation of relay S6 (at time T7) to vent chamber 288, permitting partition 290 to move downwards against piston 292. Chuck 24 therefore moves away from brake shoe 196 to its accelerating position. A position sensor 308 adjacent pivot mounting 32 senses the arrival of chuck 24 in its accelerating position, and initiates operation of the acceleration motor built into the chuck structure.

After a time delay sufficient to permit adequate acceleration of chuck 24, relay S7 is operated at time T8 to pressurize the upper portion of chamber 286 (above piston 296) and vent the lower portion of that chamber. Simultaneously, relay S8 is operated to pressurize piston 306 to urge it upwards against the balls 302, releasing the safety clamp on rod 160. Piston 296 is therefore now free to move downwardly along the cylinder under the effect of the pressurization in the upper portion of chamber 286. Simultaneously, relay S9 is operated to pressurize the cylinder 172A associated with swing arm 28 to draw chuck 24 into its retracted position.

While chuck 24 is moving along its path 29 (FIG. 7), but before it has reached its end winding position, the winding operation on chuck 26 is broken off at time T9. This step occurs under the direct control of the timing clock in predetermined timed relation to the operation of relays S6 to 9 referred to above. Upon breaking off of winding on chuck 26, relay S1 (FIG. 16) drops out and valve S1V immediately vents the upper portion of chamber 252. Simultaneously, relay S10 pressurizes auxiliary chamber 260 to cause clamping piston 274 to urge balls 272 downwardly as viewed in FIG. 16, thereby clamping them against wedging member 270 and rod 268. Regardless of the instantaneous position of piston 266 in the cylinder, therefore, it is secured to the cylinder and must follow the movement of the latter as it travels downwardly relative to the fixed piston 262 under the weight of the package 42 (FIG. 3) carried by the chuck 26. The downward movement of the cylinder continues until piston 262 reaches the upper end wall of the cylinder. Thus, the cylinder and piston 266 travel through a predetermined distance corresponding to the spacing between partition 256 and the upper end wall of the cylinder. Swing arm 30 travels through a corresponding arc and chuck 26 moves through a corresponding portion of its path 31 to create the thread length T (FIG. 3).

After allowing sufficient time for chuck 26 to withdraw its packages sufficiently from friction drive roller 18, the timer operates double relay S11 (FIG. 17) at time T10. These relays operate the corresponding switches S11V to provide additional pressure to the upper portion of chamber 286 thereby driving chuck 24 more rapidly downwardly towards its end winding position. When chuck 24 is in that position, in which it intercepts the thread length T as shown in FIG. 3, relay S5 (FIG. 16) is again operated (time T11) to begin the previously described movements of the transfer tail guide 282. During this movement, relay S9 (FIG. 17) drops out (time T12), thereby causing return of chuck 24 to its extended position. At the same time, relays S11 drop out so that valve S7 takes over pressurization of chamber 286, control of such pressurization now being effected via adjustable pressure reducing valve 66A, cam-follower 68A and cam 70A which correspond with the similarly numbered parts of the weight compensation system already described for chuck 26. Packages now begin to form on the upper chuck, which begins its return movement along the path 29.

Meanwhile, relay S4 (FIG. 16) has been operated at time T10 during the final stage of movement of chuck 24 towards its end winding position. Via an AND gate 310, relays S4 and S10 together initiate operation of a time delay mechanism 312 details of which will not be described herein. The time delay mechanism operates automatically after a predetermined delay to cancel operation of the auxiliary clamping piston 274 and to operate instead the release piston 276 so that rod 268 is left free for further movement relative to its cylinder. Relay S4 also incidentally causes operation of the auxiliary guide 44, but this is of no significance in the transfer operation illustrated in FIG. 3 and described immediately above. As soon as rod 268 is freed from its clamp, it will be driven downwardly under the weight of the packages on chuck 26 until piston 266 reaches the lower end of chamber 254, chuck 26 then being in its rest position and engaging the brake structure 200 (FIG. 7). This downward movement of the piston is possible because switch 320 has been reset at time T9 in response to switching of valve S1V, and has vented the lower portion of chamber 254. Relays S4 and S10 drop out at time T13 with relay S5, so that these auxiliaries are reset in preparation for the next transfer operation.

A position sensor 314 (FIG. 17) is associated with the pivot mounting 32 of swing arm 28 and initiates operation of a length measuring system as soon as chuck 24 reaches its end winding position. When the length measuring system indicates that the packages on chuck 24 have reached a desired size, the measuring system once again initiates operation of the timer to begin the series of operations already described for the relays S1 to 5 so that the lower chuck is brought into its end winding position and begins to take up filament.

This time, however, a full package 40 (FIG. 4) is carried by the chuck 24. The winding operation on chuck 24 is broken off by switching of valve S7 at time T 16 after arrival of chuck 26 in its accelerating position but before chuck 26 has begun movement from the accelerating position to the end winding position. As soon as valve S7 switches, a relatively high pressure is applied to the lower portion of chamber 286, so that piston 296 is driven upwardly to carry package 40 away from friction drive roller 18 and create the thread length L shown in FIG. 4. Relay S8 also drops out at time T16, so that the safety clamp on rod 160 is again operative, but this does not prevent upward movement of the rod.

The upward movement of piston 296 in the cylinder continues until the piston reaches the upper end of chamber 286. At this time, chuck 24 is in its accelerating position, because relay S6 is still operated so that the upper portion of chamber 288 is still vented. Chuck 24 remains in this position until the filament has been transferred to the lower chuck 26, and relay S6 drops out at the completion of the transfer operation so that the upper portion of chamber 288 is once again pressurized to force partition 290 and its cylinder upwardly to move chuck 24 into its rest position.

The invention is not limited to details of the systems illustrated in the drawings. In particular, the clamping sytems for securing the piston rods to their cylinders can be altered as desired or found convenient. The precise circuitry shown in the drawings is given by way of example only; alternative arrangements for carrying out the operating sequence generally described above can be designed by those skilled in the sequence control art.

It will be appreciated that the developments described herein, particularly the arrangement of the piston and cylinder operating means as shown in FIG. 16, enable the complete sequence of swinging movements to be controlled and effected by a single pressure fluid operated drive means. This enables elimination of the additional mechanism for controlling return movement of the lower chuck immediately after breaking off winding, as described with reference to FIG. 5. In a particularly advantageous arrangement, the additional piston/- chamber, used to control return movement of the lower chuck after breaking off winding, has also being used to define the movement of the same chuck away from its rest position into the accelerating position. It will be understood, however, that this particular function (movement from the rest position to an accelerating position) may be unnecessary if the overall machine design is altered. For example, if the brake structures 198, 200 are made retractable, chucks 24, 26 can be released for acceleration while they remain in their rest positions. In this event there will be no need for an accelerating position on the paths 29, 31 at a location intermediate the rest and end winding positions on those paths.

The control system may include suitable sensors, of well know types, to indicate thread breaks or other faults and initiate appropriate control cycles, e.g. premature breaking off of winding and/or shut down of the machine.

Figure 6:
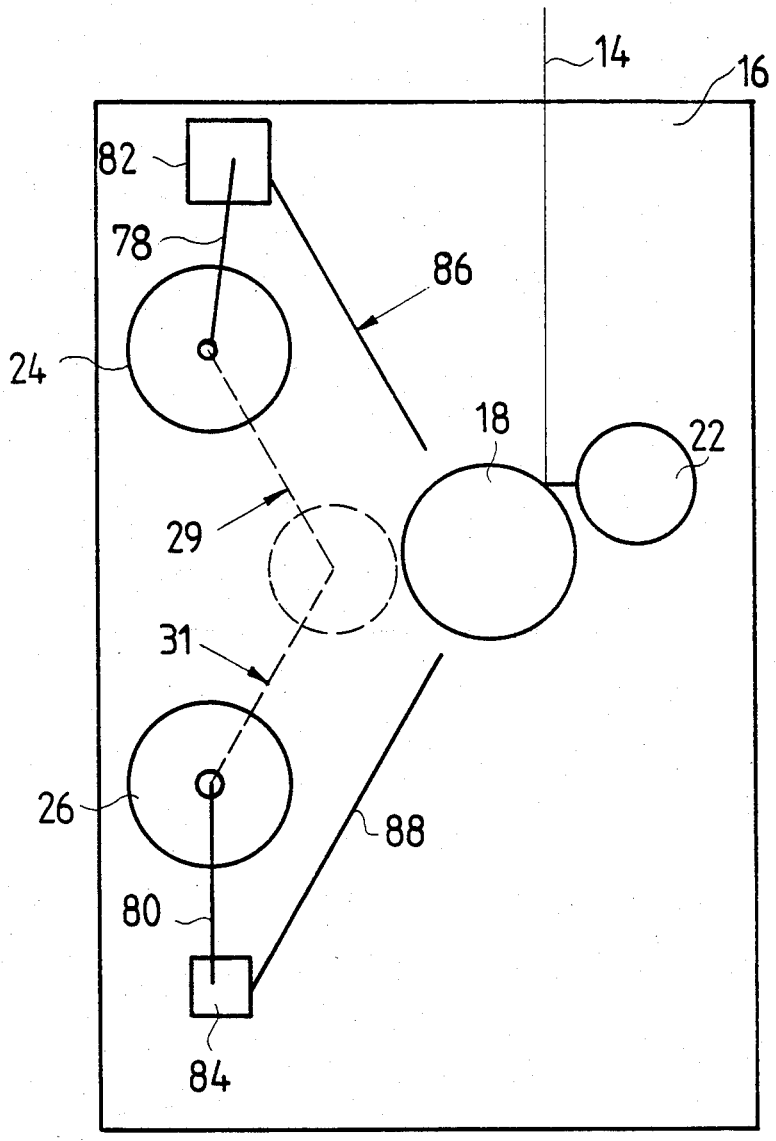

The invention is not limited to the use of swing arms to move the chucks towards and away from the winding position. In many circumstances it may be preferred to use a linear guide system, e.g. of the type shown in FIG. 6. In this Figure, parts corresponding to parts shown in FIG. 1 have corresponding reference numerals. As shown, each chuck 24, 26 is carried by an arm 78,80 respectively fixed to or integral with a carriage 82, 84 respectively. The chucks extend cantilever-fashion from the arms 78, 80 which, together with the carriages 82, 84 are contained within the housing 16. Each carriage 82, 84 runs on a linear track 86,88 respectively along which the carriage, and therefore its corresponding chuck, can move towards and away from the friction drive roller 18. As shown in FIG. 6, the angles of inclination of the tracks 86,88 correspond fairly closely with the general lines of movement of the chucks 24, 26 along the paths shown in FIG. 1.

The major advantages of the illustrated machines relative to the prior art are as follows -

1. Primary advantage—the illustrated system requires only one movement of each chuck relative to the single fixed drive roller, but reliable thread transfer during changeover is achieved without complex auxiliary thread transfer systems
2. the chucks and their mountings can be isolated from each other so that transfer of shock and vibration from one to the other is substantially prevented
3. the paths of movements of the chucks are relatively short thus requiring lower accelerations of the chucks along the paths, and lower acceleration forces
4. it is possible to arrange the chuck "beside" the friction roll when the chuck is in the winding position, that is, the winding zone Z lies in or near the horizontal plane. Thus, deformation of the chuck during winding of packages, due to increasing package weight and cantilever mounting of the chuck, has less effect in varying the effective contact between the packages and the friction drive roller
5. since the chuck guide systems (swing arms and guide tracks) are independent from one another, it is easier to adjust the parts of the machine relative to one another and to obtain exact relative positionings
6. the contact pressure is easily regulated via the same system which controls movement of the chucks towards and away from the friction drive roller
7. as a summary of the above advantages, the machine is relatively simple both to construct and to control and is therefore relatively robust and economical to build and operate.

It should be added that movements of the parts supporting the chucks (that is, in most embodiments, the swing arms) can be damped as required. For example, in the embodiments of FIGS. 1, 5 and 7, pressure fluid containing piston and cylinder units can be provided between the swing arms and suitable abutments in the headstocks. These units are additional to the pressure fluid operated arm moving cylinders, the additional units serving as damping means. Such damping units are generally well known and will not be described in detail. By way of example only, flow of pressure fluid between chambers within the cylinder may be caused by movement of the piston and may the throttled to give the required damping.

What is claimed is:

1. A winder for thread comprising a friction drive member rotatable about a longitudinal axis thereof to receive a thread thereabout, a first chuck movable along a first path between a rest position spaced from said friction drive member and a winding position adjacent said friction drive member to receive a thread from said drive member;

a second rotatable chuck movable along a second path between a rest position spaced from said friction drive member and a winding position adjacent said friction drive member to receive a thread thereon, said paths being so disposed that a chuck moving towards the winding position thereof intercepts a length of thread extending between said friction drive member and a chuck moving away from the winding position thereof, a headstock structure, a pivotally mounted swing arm supporting one of said chucks, a two stage extensible and retractable means between said headstock structure and said swing arm for pivoting said swing arm to move said one chuck in said respective path, and control means for operating one stage of said means upon termination of a winding operation to move said swing arm and said one chuck in said respective path to a position at which a length of thread extends between said one chuck and said friction drive member for interception by the other chuck and for sequentially operating the other stage to move said one chuck to said rest position thereof after transfer of the thread to said other chuck.

2. A winder as set forth in claim 1 wherein said extensible and retractable means is a piston and cylinder means.

3. A winder as set forth in claim 2 where said piston and cylinder means includes a cylinder and first and second pistons independently and slidably mounted in said cylinder, one of said pistons being secured to said swing arm and the other of said pistons being secured to said head stock structure.

4. A winder as set forth in claim 3 wherein said second piston provides one element of an auxiliary means for limiting a change in wrap angle of a thread disposed about said friction drive member.

5. A winder as set forth in claim 3 which further comprises a clamping means in said cylinder for clamping one of said pistons to said cylinder during movement of the other of said pistons relative to said cylinder.

6. A winder as set forth in claim 3 wherein said cylinder includes a first partition dividing said cylinder into two chambers, each said piston being slidably mounted in a respective chamber, and a second partition defining an auxiliary chamber between said second partition and an end of said cylinder, and which further comprises a clamping means in said auxiliary chamber for selectively clamping one of said pistons to said cylinder during movement of the other of said pistons relative to said cylinder.

7. A winder as set forth in claim 6 wherein said control means moves said one chuck sequentially from said rest position to an accelerating position, from said accelerating position to said winding position, and from said winding position towards said rest position.

8. A winder as set forth in claim 7 wherein said control means further actuates said piston and cylinder means to accelerate movement of said chuck from said winding position towards said rest position at the end of a winding operation to create a free thread length between said drive roller and said chuck.

9. A winder as set forth in claim 6 wherein said control means includes a first valve connected to one of said chambers for selectively pressurizing said one chamber to effect movement of said piston therein with a corresponding movement of said chuck from said rest position to said acceleration position, a second valve connected to the other of said chambers for selectively pressurizing said other chamber to effect movement of said piston therein with a corresponding movement of said chuck from said accelerating position to said winding position and an adjustable pressure valve connected to said second valve for adjusting the pressure in said other chamber to compensate for the weight of a thread package on said chuck during a winding operation.

10. A winder as set forth in claim 3 wherein said piston and cylinder means includes a first partition dividing said cylinder into two chambers, the first piston being slidably mounted in one of said chambers and the second piston being slidably mounted in the other of said chambers, a second partition defining an auxiliary chamber between said second partition and an end of said cylinder, and a clamping means in said auxiliary chamber for selectively clamping said first piston to said cylinder.

11. A winder for thread comprising a friction drive member rotatable about a longitudinal axis thereof to receive a thread thereabout, a first chuck movable along a first path between a rest position spaced from said friction drive member and a winding position adjacent said friction drive member to receive a thread from said drive member, a second rotatable chuck movable along a second path between a rest position spaced from said friction drive member and a winding position adjacent said friction drive member to receive a thread thereon, said paths being so disposed that a chuck moving towards the winding position thereof intercepts a length of thread extending between said friction drive member and a chuck moving away from the winding position thereof, a headstock structure, a pivotally mounted swing arm supporting one of said chucks, a piston and cylinder means between between said headstock structure and said swing arm for pivoting said swing arm, said means including a cylinder and first and second pistons independently slidably mounted in said cylinder, one of said pistons being secured to said swing arm and the other of said pistons being secured to said headstock structure, and a clamping means in said cylinder for clamping one of said pistons to said cylinder during movement of the other of said pistons relative to said cylinder.

12. A winder for thread comprising a friction drive member rotatable about a longitudinal axis thereof to receive a thread thereabout, a first chuck movable along a first path between a rest position spaced from said friction drive member and a winding position adjacent said friction drive member to receive a thread from said drive member, a second rotatable chuck movable along a second path between a rest position spaced from said friction drive member and a winding position adjacent said friction drive member to receive a thread thereon, said paths being so disposed that a chuck moving towards the winding position thereof intercepts a length of thread extending between said friction drive member and a chuck moving away from the winding position thereof, a headstock structure;

a pivotally mounted swing arm supporting one of said chucks, a piston and cylinder means between said headstock structure and said swing arm for pivoting said swing arm, said means including a cylinder, first and second pistons independently slidably mounted in said cylinder, one of said pistons being secured to said swing arm and the other of said pistons being secured to said headstock structure, a first partition dividing said cylinder into two chambers with each said piston being slidably mounted in a respective chamber, a second partition defining an auxiliary chamber between said second partition and an end of said cylinder, and a clamping means in said auxliary chamber for selectively clamping one of said pistons to said cylinder during movement of the other of said pistons relative to said cylinder.

* * * * *

UNITED STATES PATENT AND TRADEMARK OFFICE

CERTIFICATE OF CORRECTION

PATENT NO. : 4,497,450

DATED : February 5, 1985

INVENTOR(S) : KURT SCHEFER and KURT SALVISBERG

It is certified that error appears in the above-identified patent and that said Letters Patent is hereby corrected as shown below:

In the face page, correct the Assignee from "Sulzer Brothers Limited" to -RIETER MACHINE WORKS, LTD.-

Signed and Sealed this

*Thirty-first* Day of *December 1985*

[SEAL]

*Attest:*

DONALD J. QUIGG

*Attesting Officer*

*Commissioner of Patents and Trademarks*